US011363697B2

(12) United States Patent
Nakamura et al.

(10) Patent No.: US 11,363,697 B2
(45) Date of Patent: Jun. 14, 2022

(54) LIGHTING DEVICE

(71) Applicant: NICHIA CORPORATION, Anan (JP)

(72) Inventors: Naoki Nakamura, Nagano (JP); Kosuke Gomi, Nagano (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/147,069

(22) Filed: Jan. 12, 2021

(65) Prior Publication Data

US 2021/0227668 A1 Jul. 22, 2021

(30) Foreign Application Priority Data

Jan. 18, 2020 (JP) ..... JP2020-006444

(51) Int. Cl.
*H05B 47/155* (2020.01)
*H05B 47/105* (2020.01)

(52) U.S. Cl.
CPC ..... *H05B 47/105* (2020.01); *H05B 47/155* (2020.01)

(58) Field of Classification Search
CPC .... H05B 47/10; H05B 47/105; H05B 47/155; H05B 47/11; H05B 45/10; H05B 45/48; H05B 45/54
See application file for complete search history.

(56) References Cited

U.S. PATENT DOCUMENTS

| | | | | |
|---|---|---|---|---|
| 8,556,471 | B2 * | 10/2013 | Pahlke | F21V 19/0005 362/520 |
| 10,295,149 | B2 * | 5/2019 | Kang | F21V 17/06 |
| 2011/0149565 | A1 * | 6/2011 | Marson | G02B 19/0066 438/27 |
| 2012/0206050 | A1 * | 8/2012 | Spero | F21V 19/02 315/152 |

FOREIGN PATENT DOCUMENTS

| | | | |
|---|---|---|---|
| JP | 2013164916 | A | 8/2013 |
| JP | 2015060639 | A | 3/2015 |
| JP | 2015159028 | A | 9/2015 |
| JP | 5902499 | B2 | 4/2016 |
| JP | 2017111341 | A | 6/2017 |
| JP | 2017188231 | A | 10/2017 |
| JP | 2018045847 | A | 3/2018 |
| JP | 2019003762 | A | 1/2019 |
| JP | 2019021583 | A | 2/2019 |
| JP | 2019056914 | A | 4/2019 |
| JP | 2019168655 | A | 10/2019 |
| JP | 2020042964 | A | 3/2020 |

* cited by examiner

*Primary Examiner* — Haissa Philogene
(74) *Attorney, Agent, or Firm* — Global IP Counselors, LLP

(57) ABSTRACT

A lighting device includes a plurality of lighting modules and a plurality of control devices. The lighting modules each includes a plurality of light emitting devices aligned in an array form or a staggered form. The control devices are configured to adjust light quantities of the light emitting devices of each of the lighting modules so that, when light is irradiated on a first target surface separated by a prescribed distance from the lighting modules, a sum of light quantities per unit area of a part for which light from the lighting modules overlaps in the first target surface is within ±20% with respect to a light quantity per unit area of a part for which light does not overlap in the first target surface.

19 Claims, 20 Drawing Sheets

LIGHTING DEVICE

CROSS-REFERENCE TO RELATED PATENT APPLICATION

This application claims priority to Japanese Patent Application No. 2020-006444, filed on Jan. 18, 2020, the disclosure of which is hereby incorporated herein by reference in its entirety.

BACKGROUND

Technical Field

The present invention relates to a lighting device.

Description of Related Art

Lighting devices used in production spaces such as TV studios, theater stages, etc., are known. In recent years, lighting devices using LEDs, etc., as the light source are known. For example, Japanese Unexamined Patent Publication No. 2013-164916 discloses a lighting device comprising a light source, a rod lens, a reflector, and a projection lens system.

SUMMARY

A lighting device according to one mode of the present disclosure includes a plurality of lighting modules and a plurality of control devices. The lighting modules each includes a plurality of light emitting devices aligned in an array form or a staggered form. The control devices are configured to adjust light quantities of the light emitting devices of each of the lighting modules so that, when light is irradiated on a first target surface separated by a prescribed distance from the lighting modules, a sum of light quantities per unit area of a part for which light from the lighting modules overlaps in the first target surface is within ±20% with respect to a light quantity per unit area of a part for which light does not overlap in the first target surface.

A lighting device according to another mode of the present disclosure includes a plurality of lighting modules and a plurality of control devices. The lighting modules each includes a plurality of light emitting devices aligned in an array form or a staggered form. The control devices are configured to adjust light quantities of the light emitting devices of each of the lighting modules so that, when light is irradiated on a first target surface separated by a prescribed distance from the lighting modules, a sum of light quantities per unit area of a part for which light from the lighting modules overlaps in the first target surface is within ±40% with respect to a light quantity per unit area of a part for which light does not overlap, and a sum of the light quantities per unit area of a part for which light from the lighting modules overlaps in a virtual second target surface between the lighting modules and the first target surface is within ±30% with respect to a light quantity per unit area of a part for which light does not overlap in the virtual second target surface.

BRIEF DESCRIPTION OF THE DRAWINGS

A more complete appreciation of embodiments of the invention and many of the attendant advantages thereof will be readily obtained by reference to the following detailed description when considered in connection with the accompanying drawings.

DETAILED DESCRIPTION

Figure 1:
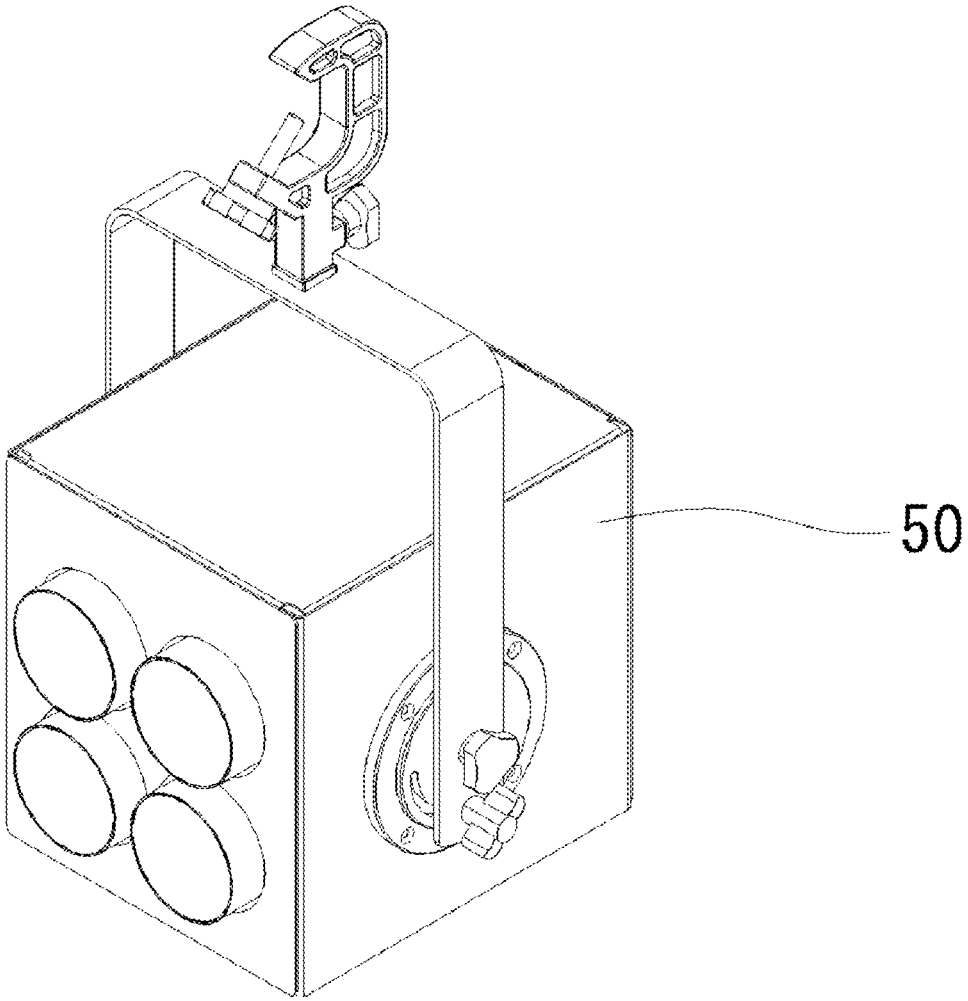
FIG. 1 is a schematic perspective view showing a lighting module of a first embodiment.

Hereafter, the lighting device of embodiments and the manufacturing method thereof are explained. The drawings referenced in the explanation hereafter schematically show the embodiments, so there are cases when the scale, spacing, positional relationship, etc., of the members is exaggerated, or when an illustration of a portion of a member is omitted. Also, in the plan view or the cross section view, there are cases when the scale or spacing of the members does not match. Also, with the explanation hereafter, as a general rule, the same name and code number indicate a member that is the same or similar, and a detailed explanation will be omitted as appropriate. Also, in this specification, "upper," "lower," etc., indicate the relative position between component elements, and are not intended to indicate the absolute position.

The relationship of color names and chromaticity coordinates, the relationship of the wavelength range of light and the color name of monochromatic light, etc., are according to JIS Z8110. More specifically, 380 nm to 410 nm is violet, 410 nm to 455 nm is blue-violet, 455 nm to 485 nm is blue, 485 nm to 495 nm is blue-green, 495 nm to 548 nm is green, 548 nm to 573 nm is yellow-green, 573 nm to 584 nm is yellow, 584 nm to 610 nm is yellow-red, and 610 nm to 780 nm is red.

The height of the lighting device is explained with 4.5 m as an example in a theater stage, for example, but it is also possible to use any height between approximately 3 m and approximately 20 m, so is not limited to this specific example.

The first target surface is the floor in a theater stage, for example. The second target surface is a height of 1.5 m from the first target, and is a flat surface at a height of 1.5 m from the floor surface in the theater stage, for example. For example, using an example of a person of height approximately 170 cm, the face height correlates to approximately 150 cm. The third target surface is a height of 1 m from the first target surface, and for example is a flat surface at a height of 1 m from the floor surface in the theater stage. For example, using an example of a person of height 170 cm, the abdomen height correlates to approximately 100 cm. A fourth target surface is a height of 1.69 m from the first target surface, and for example correlates to a person of height approximately 170 cm.

First Embodiment

Figure 2:
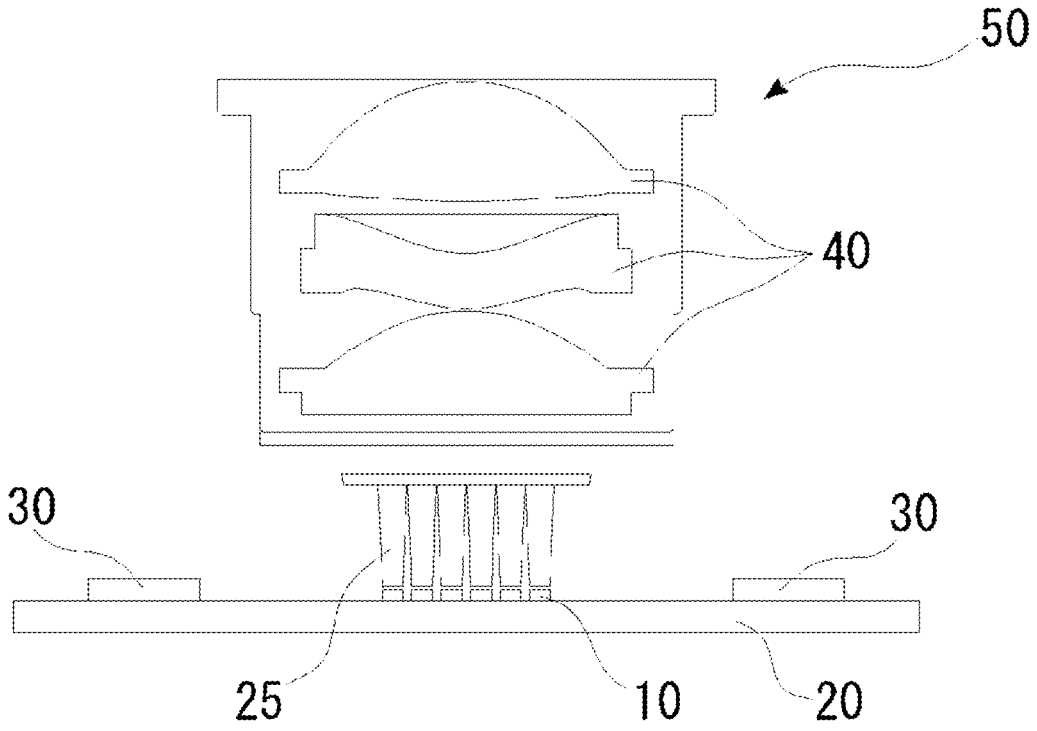
FIG. 2 is a schematic cross section view showing the lighting module of the first embodiment.
Figure 3:
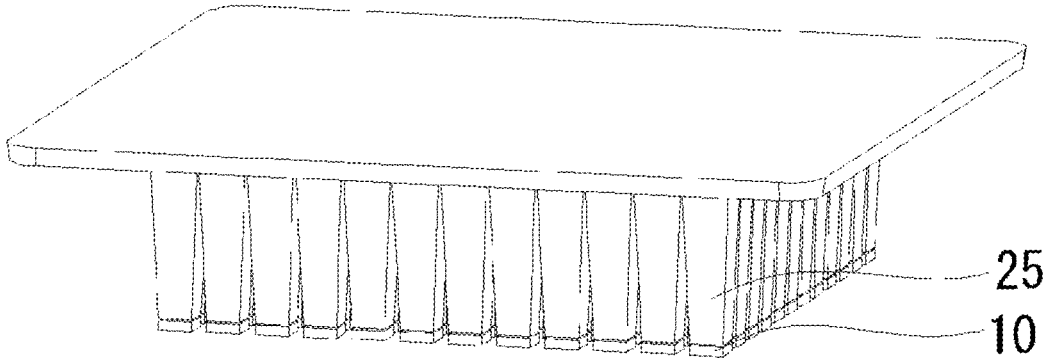
FIG. 3 is a schematic perspective view showing a portion of the lighting module of the first embodiment.
Figure 4:
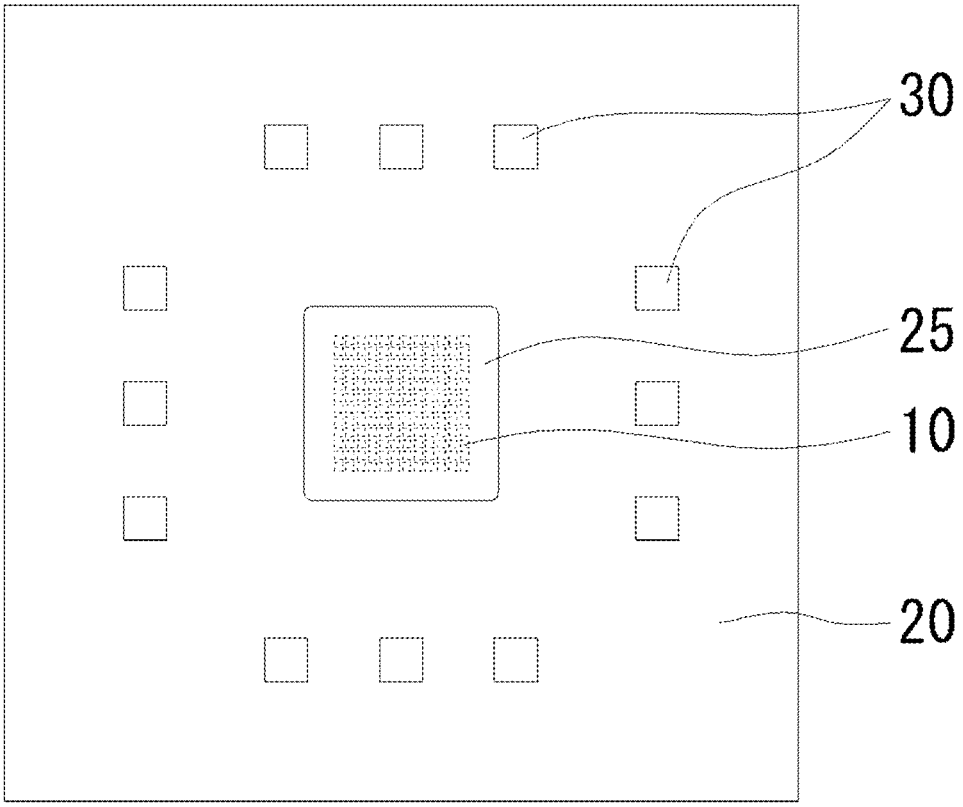
FIG. 4 is a schematic plan view showing light emitting devices and control devices inside the lighting module of the first embodiment.
Figure 5:
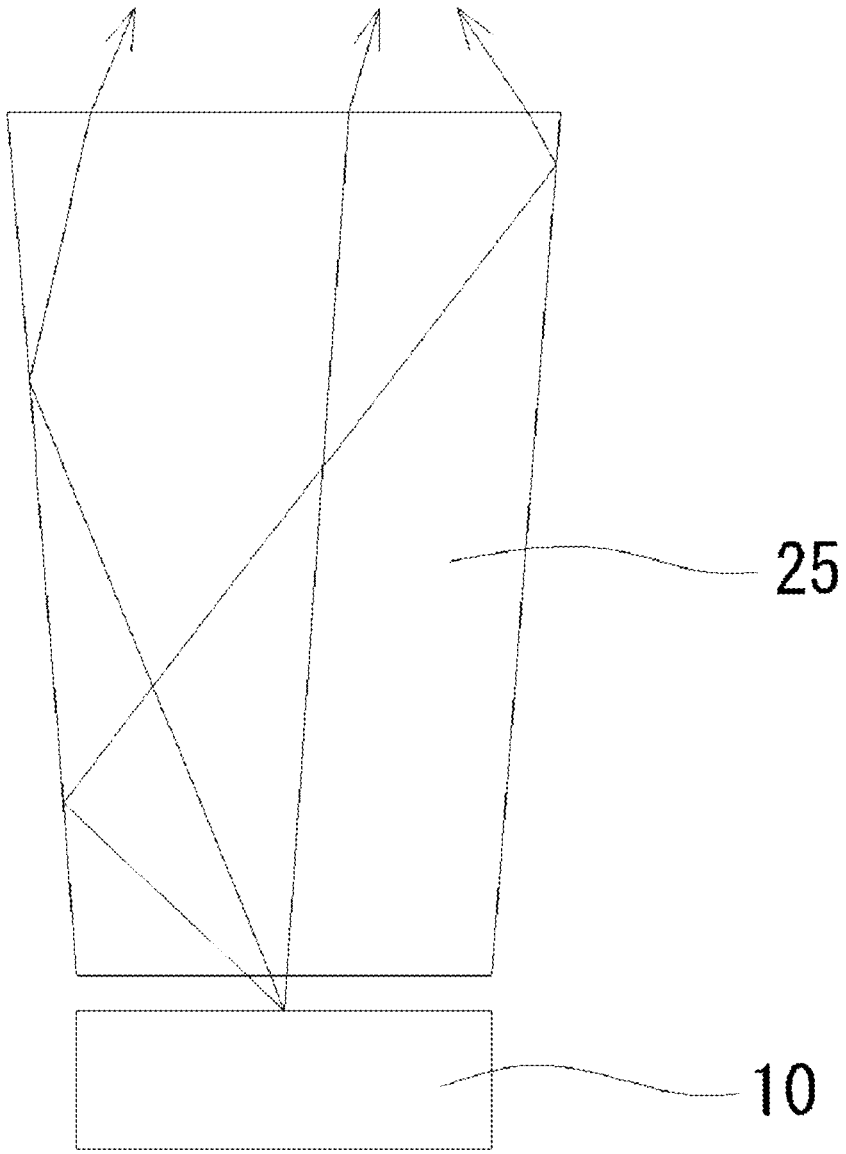
FIG. 5 is a schematic cross section view showing the placement of the light emitting device and a rod lens of the first embodiment.
Figure 6:
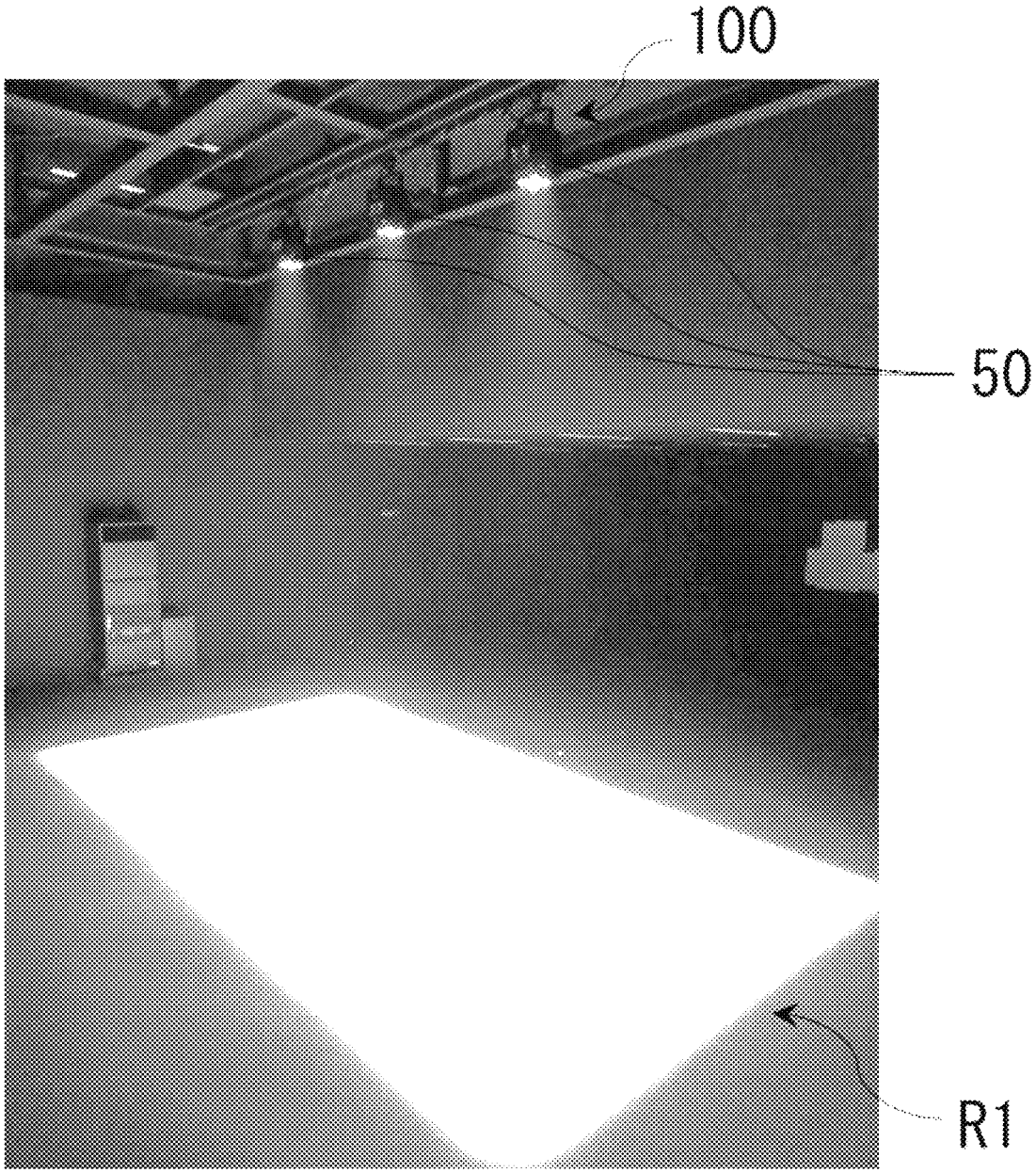
FIG. 6 is a photograph showing the state of the lighting device of the first embodiment irradiated on the first target surface.

The drawings will be used to explain the lighting device of a first embodiment. FIG. 1 is a schematic perspective view showing the lighting module of the first embodiment. FIG. 2 is a schematic cross section view showing the lighting module of the first embodiment. FIG. 3 is a schematic perspective view showing a portion of the lighting module of the first embodiment. FIG. 4 is a schematic plan view showing light emitting devices and control devices inside the lighting module of the first embodiment. FIG. 5 is a schematic cross section view showing the placement of the light emitting device and the rod lens of the first embodiment. FIG. 6 is a photograph showing the state of the lighting device of the first embodiment irradiated on the first target surface. FIG. 1 shows a lamp for which four lighting modules are placed in one box. This is not limited to one lighting module for one lamp, and a plurality may be provided.

A lighting device 100 of a first embodiment comprises: a plurality of lighting modules 50 for which a plurality of light emitting devices 10 are aligned in an array form or a staggered form; and control devices 30 with which, when light is irradiated on a first target surface R1 separated by a prescribed distance from the plurality of lighting modules 50, the light quantity of each of the plurality of light emitting devices 10 is adjusted so that the sum of the light quantity per unit area of the part for which light overlaps in the first target surface R1 is within ±20% with respect to the light quantity per unit area of the part for which light does not overlap. This makes it possible to provide a highly efficient lighting device that can reduce illuminance unevenness. Here, "per unit area" is a square shape of 200 mm×200 mm. However, it is also possible to use from 100 mm×100 mm to 1000 mm×1000 mm, etc., depending on the distance from the lighting modules 50 to the first target surface.

One lighting module 50 has a plurality of light emitting devices 10 aligned in an array form (including a two-dimensional array) or a staggered form on a substrate 20. In the illustrated embodiment, the plurality of light emitting devices 10 are placed in a two-dimensional matrix (a two-dimensional array) form. Also, the control devices 30 are placed on the substrate 20, and on the outer circumference of the light emitting device. The control devices 30 may be placed inside the lighting module 50, or may be placed separate from the lighting module 50. A rod lens 25 is placed on each of the plurality of light emitting devices 10 placed on the substrate 20. The rod lens 25 has the role of narrowing the orientation from the light emitting device 10, and has the role of making the light from the light emitting device 10 uniform. The rod lens 25 has an incident surface facing the light emitting device, and an emitting surface for discharging to the outside the light that entered from the incident surface. For the rod lens 25, it is possible to use an item having a tapered shape for which the emitting surface has a broader area than the incident surface. One rod lens 25 is provided for one light emitting device 10, but it is also possible to provide a plurality of light emitting devices 10 for one rod lens 25. For the rod lens 25, in addition to providing a plurality of rod lenses 25 on the plurality of light emitting devices 10, it is also possible to form a rod lens unit for which there are a plurality of incident surfaces and one emitting surface. By using a rod lens unit, the rod lens 25 does not have to be individually attached to each light emitting device 10, so it is easy to place the rod lens 25 on the light emitting device 10. The light emitting device 10 and the rod lens 25 may be placed with a gap open therebetween, or may be bonded directly. The lighting module 50 has a lens 40 placed on the top part of the light emitting device 10. In addition to a convex lens or a concave lens for the lens 40, it is also possible to use a plurality of lenses in combination. The lens 40 can be a fixed type or a variable type.

The number of light emitting devices 10 is set as appropriate according to the breadth of the irradiated first target surface R1, and it is possible to use 6×6, 8×8, 10×10, 6×10, 10×20, etc. The light emitting devices aligned in an array form or a staggered form are not limited to being square or rectangular, but can also have a polygon shape such as a triangle shape, pentagon shape, hexagon shape, etc., or a form such as a trapezoid or parallelogram, an approximate circle, an approximate ellipse, etc. The light emitting device can be only a semiconductor light emitting element such as a light emitting diode, etc., but it can also be an item for which a wavelength conversion member is placed on the semiconductor light emitting element. By using a combination of the semiconductor light emitting element and the wavelength conversion member, in addition to white or neutral white, it is also possible to realize a large variety of colors such as warm colors, cold colors, blue, green, yellow, red, etc. The plurality of light emitting devices are preferably configured from light emitting devices of two or more different types of color temperature.

For example, when a lighting device using three lighting modules irradiates the floor of a theater stage which is the first target surface R1, it is possible to provide a highly efficient lighting device with little illuminance unevenness. With a suspension light used with stage lighting, normally a lighting module with broad orientation is less likely to cause illuminance unevenness, but since the orientation is broad, irradiation sometimes occurs on other than a performer or irradiation object intended for irradiation. On the other hand, with a narrow orientation, when light is overlapped, illuminance unevenness occurs easily. In contrast, the lighting device of the present embodiment is a mode for which illuminance unevenness does not occur easily while having a high luminous flux even when the orientation is narrow and light is overlapped. By driving the light emitting devices individually, it is possible to reduce illuminance unevenness in the first target surface R1.

Figure 7:
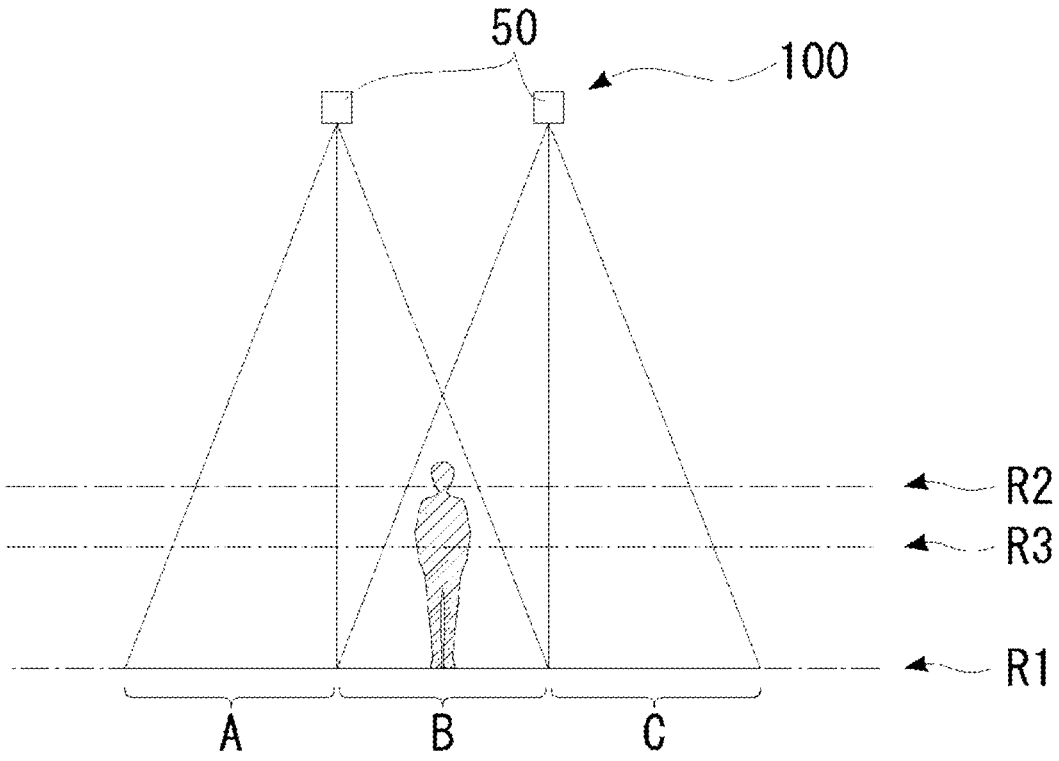
FIG. 7 is a schematic view showing the state of light irradiated on the first target surface from the lighting device of the first embodiment.

An example of the lighting device using two lighting modules is used to explain the lighting device of the first embodiment. For the convenience of explaining the invention, two lighting modules are used, but the lighting devices are not limited to this number. FIG. 7 is a schematic view showing the state of light irradiated from the lighting device of the first embodiment on the first target surface.

The lighting device 100 has two lighting modules 50. Light is irradiated toward the first target surface R1 from each lighting module 50. When having the two lighting modules 50 emit light, on the first target surface R1, there are parts A and C in which light does not overlap, and part B on which light overlaps. If the light quantity irradiating on the first target surface R1 in each of the two lighting modules 50 is all the same, the light quantity per unit area in part B in which light overlaps is twice the light quantity of the light quantity per unit area in parts A and C in which light does not overlap. In contrast, with the lighting device of the present embodiment, by individually driving each of the light emitting devices in each of the lighting modules 50, it is possible to control the light quantity irradiated on the first target surface R1 from the lighting module 50 in units of the individual light emitting devices 10. This makes it possible for the sum of the light quantity from the two lighting modules 50 in part B on which light overlaps to approach the light quantity of parts A and C for which light does not overlap. Here, the light quantity emitted from the two lighting modules 50 on part B for which light overlaps does not have to be equal, and it is possible to have the light quantity of one lighting module be high, the light quantity of the other lighting module be low, and to control to within a prescribed range. This is because for example, by making the light quantity from one lighting module large, it is possible to add shading to a person, etc., being irradiated. In other words, though there is no illuminance unevenness of the first target surface R1, it is possible to irradiate the front side of the person brightly, and to irradiate the back side of the person darkly.

The lighting device 100 preferably also does not have illuminance unevenness in a second target surface R2 separated by a prescribed distance from the first target surface R1. The height of the second target surface R2 is for example 1.5 m from the first target surface R1. It is also possible to expand the irradiation angle of the lighting module 50 without changing the distance from the lighting module 50 to the first target surface R1 if the second target surface R2 is made high.

The lighting device 100 preferably also does not have illuminance unevenness in a third target surface R3 separated by a prescribed amount from the first target surface R1. The height of the third target surface R3 is for example 1 m from the first target surface R1. The irradiation angle of the lighting module 50 can be made narrower by using the third target surface R3 at a position lower than the second target surface R2 as the reference without changing the distance from the lighting module 50 to the first target surface R1.

Figure 8:
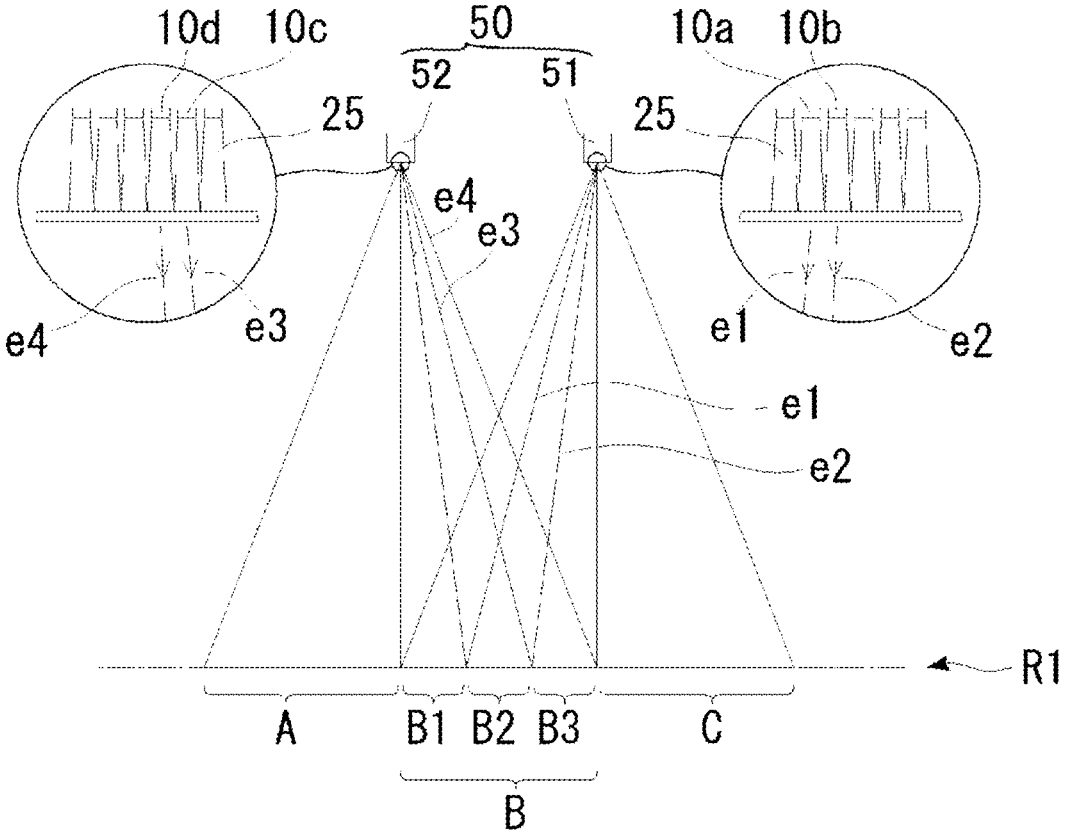
FIG. 8 is a schematic view showing the state of light irradiated on the first target surface from the lighting device of the first embodiment.

A lighting device using two lighting modules is used to explain the lighting device of the first embodiment. For the convenience of explaining the invention, two lighting modules were used, but the lighting devices are not limited to this number. FIG. 8 is a schematic view showing the state of light irradiated on the first target surface from the lighting device of the first embodiment. In FIG. 8, a portion of the first lighting module and the second lighting module is enlarged, but they are shown exaggerated for the convenience of the explanation. Different from the case in FIG. 7, the lighting device of FIG. 8 is different in that the light emitted from the lighting module is further individually controlled according to the irradiation distance and the light quantity.

The lighting module has a first lighting module 51 having at least a first light emitting device 10*a* and a second light emitting device 10*b*. When irradiating light on the first target surface R1 separated by a prescribed distance from the first lighting module 51, in part B in which light overlaps in the first target surface R1, when a first distance e1 from the first light emitting device 10*a* to the first target surface R1 irradiated by the first light emitting device 10*a* is longer than a second distance e2 from the second light emitting device 10*b* to the first target surface R1 irradiated by the second light emitting device 10*b*, it is preferable that the light quantity of the first light emitting device 10*a* be lower than the light quantity of the second light emitting device 10*b*.

The lighting module has a second lighting module 52 having at least a third light emitting device 10*c* and a fourth light emitting device 10*d*. The second lighting module 52 is adjacent to the first light emitting device 10*a* side of the first lighting module 51. When light is irradiated on the first target surface R1 separated by a prescribed distance from the second lighting module 52, in part B in which light overlaps in the first target surface R1, when a third distance e3 from the third light emitting device 10*c* to the first target surface R1 irradiated by the third light emitting device 10*c* is longer than a fourth distance e4 from the fourth light emitting device 10*d* to the first target surface R1 irradiated by the fourth light emitting device 10*d*, it is preferable that the light quantity of the third light emitting device 10*c* be lower than the light quantity of the fourth light emitting device 10*d*.

This makes it possible to make the sum of the light quantity of the first light emitting device 10*a* and the light quantity of the fourth light emitting device 10*d* be approximately equal to the sum of the light quantity of the second light emitting device 10*b* and the light quantity of the third light emitting device 10*c*. This makes it possible to reduce illuminance unevenness. With a lighting module such as a halogen bulb, it is not possible to do individual control of the irradiation part, so illuminance unevenness occurs easily. In contrast, using a plurality of light emitting devices, it is possible to reduce illuminance unevenness by doing individual control with the control devices.

As the relationship in the plan view of the first light emitting device 10*a* and the second light emitting device 10*b*, it is possible to have the side near the center of the plurality of light emitting devices be the second light emitting device 10*b*, and to have the side near the outer circumference of the plurality of light emitting devices be the first light emitting device 10*a*. This makes it possible to irradiate on the first target surface R1 without the main part of the respective light emitted from the first light emitting device 10*a* and the second light emitting device 10*b* overlapping. For the third light emitting device 10*c* and the fourth light emitting device 10*d*, the same as with the relationship of the first light emitting device 10*a* and the second light emitting device 10*b*, as the relationship in the plan view of the third light emitting device 10*c* and the fourth light emitting device 10*d*, it is possible to have the side near the center of the plurality of light emitting devices be the fourth light emitting device 10*d*, and to have the side near the outer circumference of the plurality of light emitting devices be the third light emitting device 10*c*. This makes it possible to irradiate the first target surface R1 without the main part of the respective light emitted from the third light emitting device 10*c* and the fourth light emitting device 10*d* overlapping. In the drawings, the light beam is written as a straight line, but this has a prescribed width and irradiates a prescribed range.

The light quantity per unit area of the parts A and C for which light does not overlap and part B for which light overlaps is preferably within ±20%, more preferably within ±15%, and especially preferably within ±10%. Also, in each of parts B1, B2, B3 for which light overlaps, the light quantity per unit area from the first lighting module 51 is different, so it is preferable to do control of the light quantity of each individual light emitting device using the control device. Also, in part B for which light overlaps, the distance from each light emitting device 10 of the first lighting module 51 and the second lighting module 52 to the first target surface R1 is each slightly different, so it is preferable to do control of the light quantity of each light emitting device according to the distance.

Here, the rod lens 25 provided on the first light emitting device 10*a* and the second light emitting device 10*b* can have a configuration inclined at a prescribed angle to the first target surface R1, and it is also possible to have a configuration in which the incline of the rod lens 25 provided on the first light emitting device 10*a* of the side near the outer circumference of the plurality of light emitting devices is inclined more than the incline of the rod lens 25 provided on the second light emitting device 10*b* of the side near the center of the plurality of light emitting devices. This is because this makes it possible to broaden the orientation of the first lighting module 51.

Figure 9:
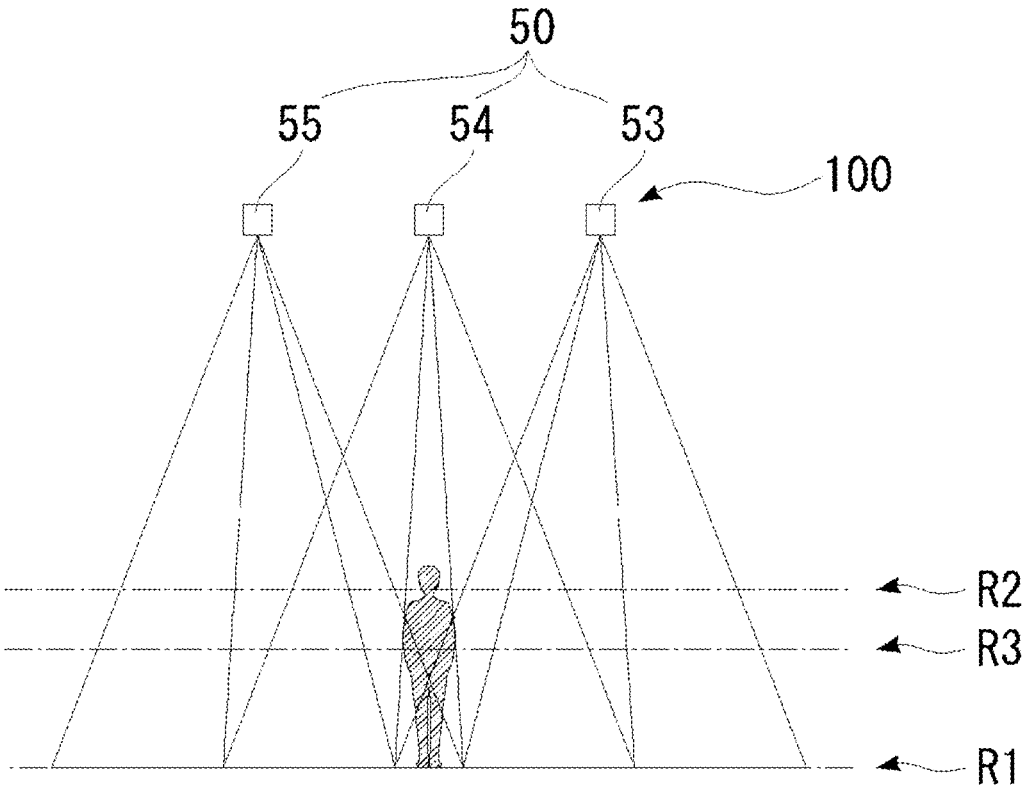
FIG. 9 is a schematic view showing the state of light irradiated on the first target surface from the lighting device of the first embodiment.
Figure 10:
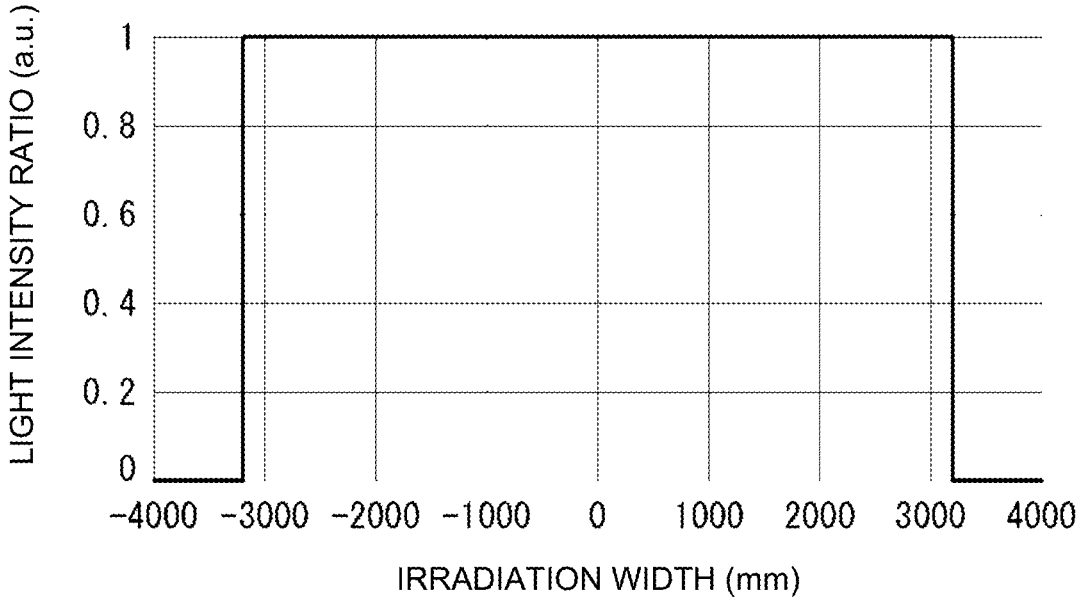
FIG. 10 is a drawing showing the cross section intensity of irradiation on the first target surface when light is irradiated on the first target surface from the lighting device of the first embodiment.
Figure 11:
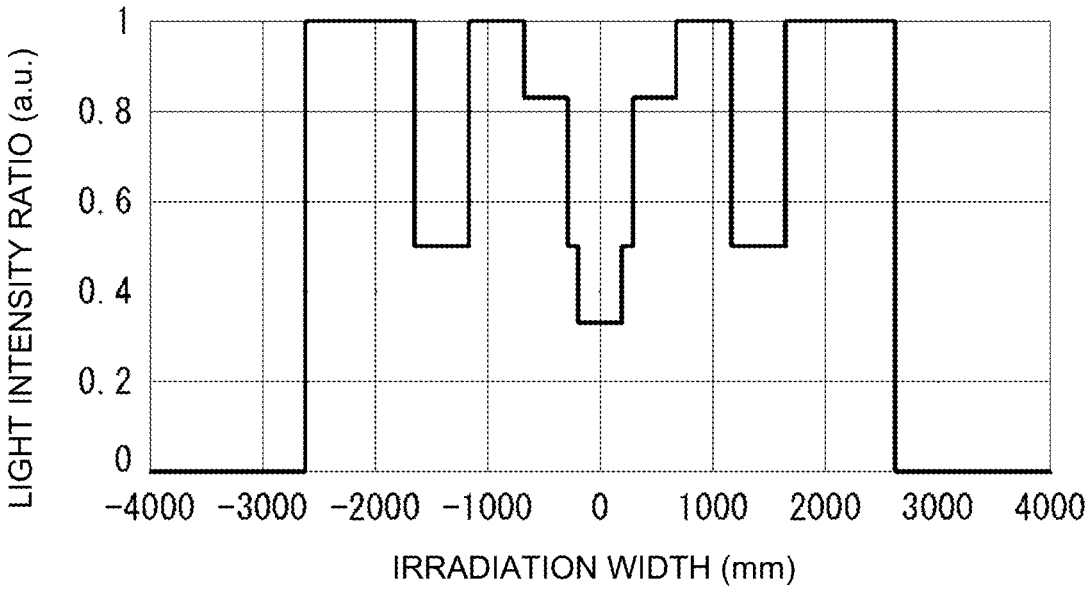
FIG. 11 is a drawing showing the cross section intensity of irradiation on a virtual second target surface when light is irradiated on the first target surface from the lighting device of the first embodiment.
Figure 12:
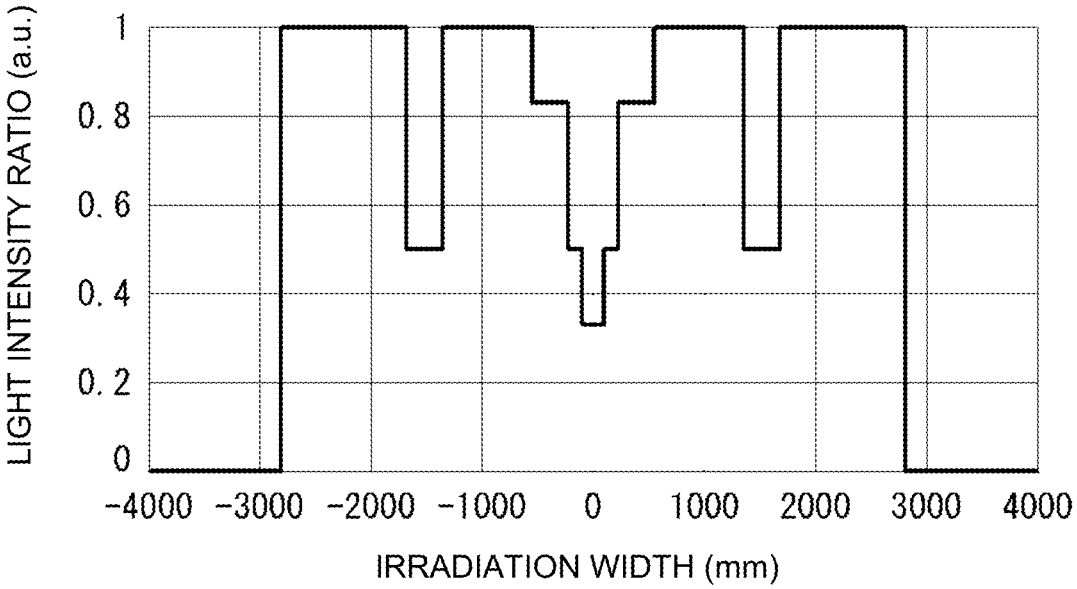
FIG. 12 is a drawing showing the cross section intensity of irradiation on a virtual third target surface when light is irradiated on the first target surface from the lighting device of the first embodiment.

An example of the lighting device using three lighting modules is used to explain the lighting device of the first embodiment. Three lighting modules are used for the convenience of explaining the invention, but the lighting devices are not limited to this number. FIG. 9 is a schematic view showing the state of light irradiated on the first target surface from the lighting device of the first embodiment. FIG. 10 is a drawing showing the cross section intensity of the irradiation on the first target surface when light is irradiated on the first target surface from the lighting device of the first embodiment. FIG. 11 is a drawing showing the cross section intensity of irradiation on the virtual second target surface when light is irradiated on the first target surface from the lighting device of the first embodiment. FIG. 12 is a drawing showing the cross section intensity of irradiation on a virtual third target surface when light is irradiated on the first target surface from the lighting device of the first embodiment. However, the cross section intensities in FIG. 10 to FIG. 12 are the results of the simulation. In FIG. 10 to FIG. 12, the horizontal axis shows the irradiation width (mm), and the vertical axis shows the light intensity ratio (a.u.).

The lighting module has at least a third lighting module 53, a fourth lighting module 54, and a fifth lighting module 55. The third lighting module 53 and the fifth lighting module 55 are placed with line symmetry to the fourth lighting module 54. For line symmetry here, the line used for reference is a straight line drawn at the shortest distance from the fourth lighting module 54 to the first target surface R1. This makes it possible to have the distance between the third lighting module 53 and the fourth lighting module 54 and the distance between the fifth lighting module 55 and the fourth lighting module 54 be equal, making illumination control easier.

In the first target surface R1, the sum of the light quantity per unit area of the part for which light overlaps from each of the third lighting module 53, the fourth lighting module 54, and the fifth lighting module 55, in the first target surface R1, the sum of the light quantity per unit area of the part for which light overlaps from the third lighting module 53 and the fourth lighting module 54, and in the first target surface R1, the sum of the light quantity per unit area of the part for which light overlaps from the fifth lighting module 55 and the fourth lighting module 54 are preferably within ±20%. This makes it possible to reduce illuminance unevenness in the first target surface R1. In other words, when the light quantity within the first target surface R1 of each of the third lighting module 53, the fourth lighting module 54, and the fifth lighting module 55 is the same, in the first target surface R1, the sum of the light quantity per unit area of the part for which light overlaps from each of the third lighting module 53, the fourth lighting module 54, and the fifth lighting module 55 should be greater than, in the first target surface R1, the sum of the light quantity per unit area of the part for which light overlaps from the third lighting module 53 and the fourth lighting module 54, but by controlling the light quantity within the first target surface R1 of each of the third lighting module 53, the fourth lighting module 54, and the fifth lighting module 55 using the control devices 30, it is possible to keep the sum of the light quantity per unit area of the part for which light overlaps from each of the third lighting module 53, the fourth lighting module 54, and the fifth lighting module 55 low. This makes it possible to have the light quantity in the three irradiation surfaces be within ±20%. Here, it is possible to keep the light quantity in the three irradiation surfaces in the first target surface R1 be within 5%.

In the first target surface R1, the light quantity from the fourth lighting module 54 in the part for which light overlaps from each of the third lighting module 53, the fourth lighting module 54, and the fifth lighting module 55 may also be lower than the light quantity from the fourth lighting module in the part for which light overlaps from the third lighting module 53 and the fourth lighting module 54. This makes it possible to reduce illuminance unevenness in the third target surface R3. In other words, this is because by broadening the part for which light overlaps from the third lighting module 53 and the fourth lighting module 54, and narrowing the part for which light overlaps of the third lighting module 53, the fourth lighting module 54, and the fifth lighting module 55, it is possible to broaden the region for which the light quantity is increased on the third target surface.

The uniformity of the second target surface R2 is 33%, and the uniformity of the third target surface R3 is also 33%. Thus, brightness and darkness occur on the second target surface R2 and the third target surface R3. However, the region of darkness in the third target surface R3 is narrower than the region of darkness in the second target surface R2, and if the irradiation object is low, the illuminance unevenness is suppressed. Furthermore, because a light emitting device using a semiconductor light emitting element, etc., is used, it is possible to make the lighting module lighter, and possible to make transport and installation of the lighting device easier.

Second Embodiment

Figure 13:
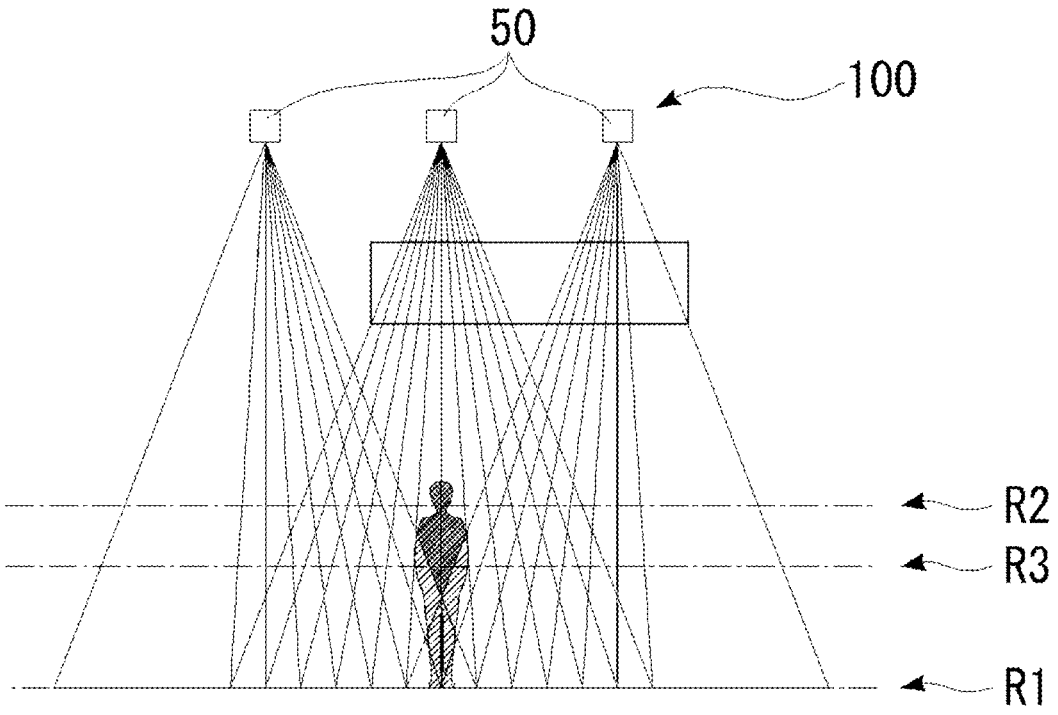
FIG. 13 is a schematic view showing the state of light irradiated on the first target surface from the lighting device of a second embodiment.
Figure 14:
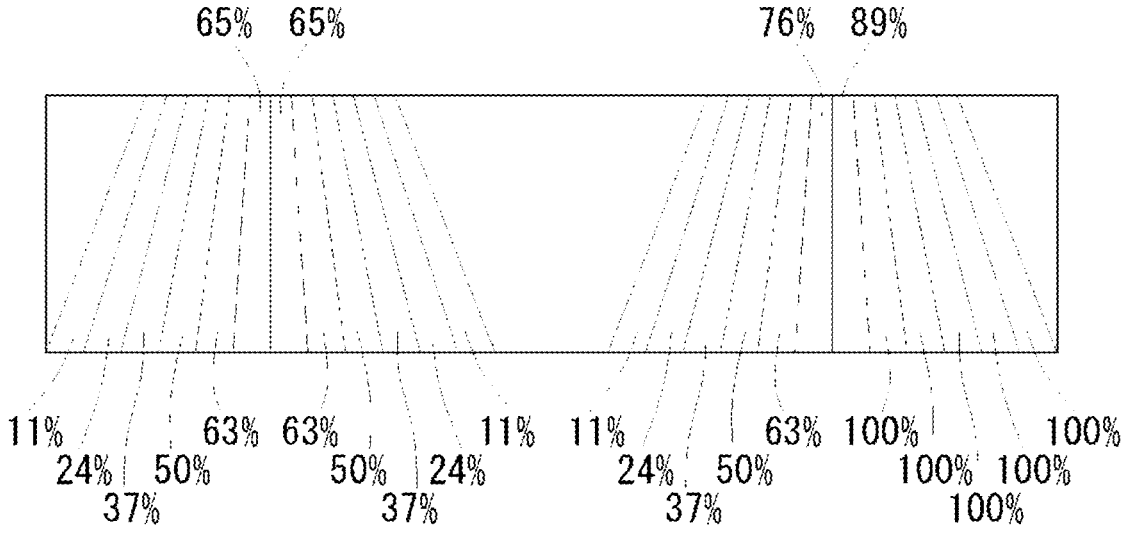
FIG. 14 is an enlarged partial view of FIG. 13 showing the state of light in the emission vicinity when light is irradiated on the first target surface from the lighting device of the second embodiment.
Figure 15:
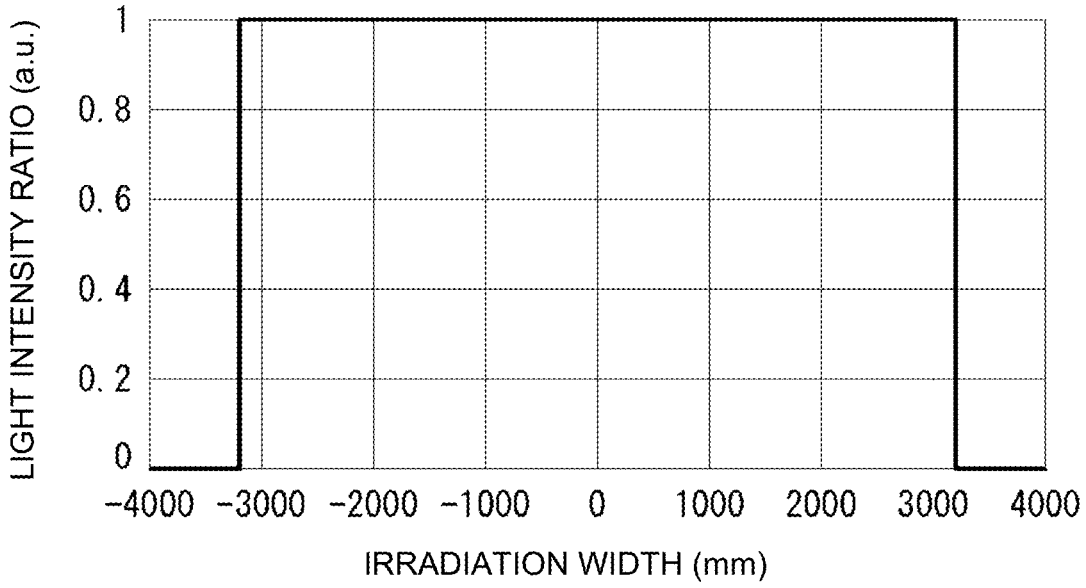
FIG. 15 is a drawing showing the cross section intensity of irradiation on the first target surface when light is irradiated on the first target surface from the lighting device of the second embodiment.
Figure 16:
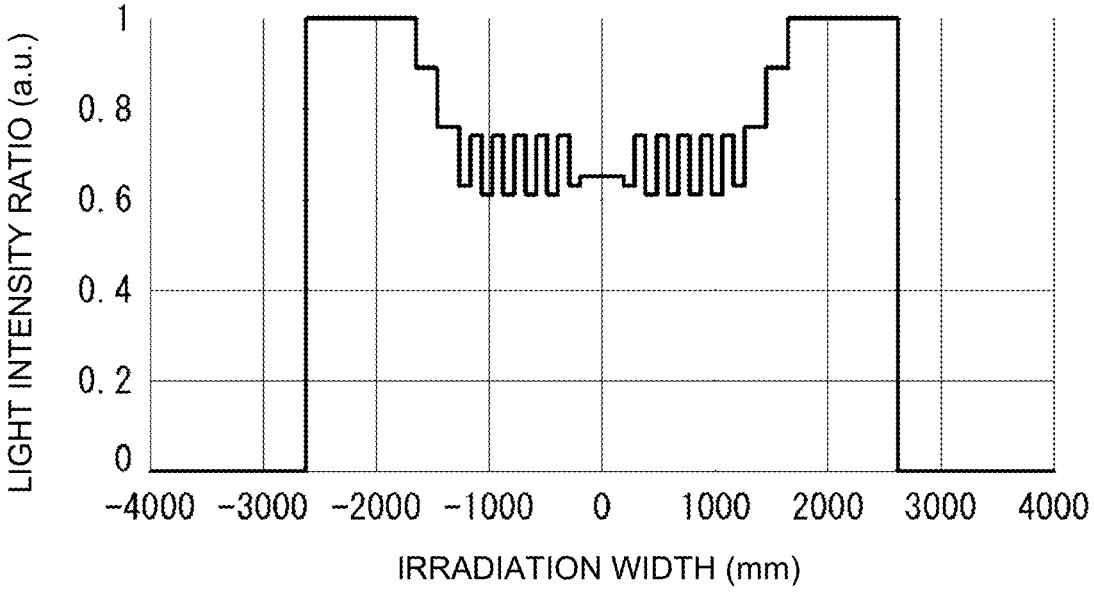
FIG. 16 is a drawing showing the cross section intensity of irradiation on a virtual second target surface when light is irradiated on the first target surface from the lighting device of the second embodiment.
Figure 17:
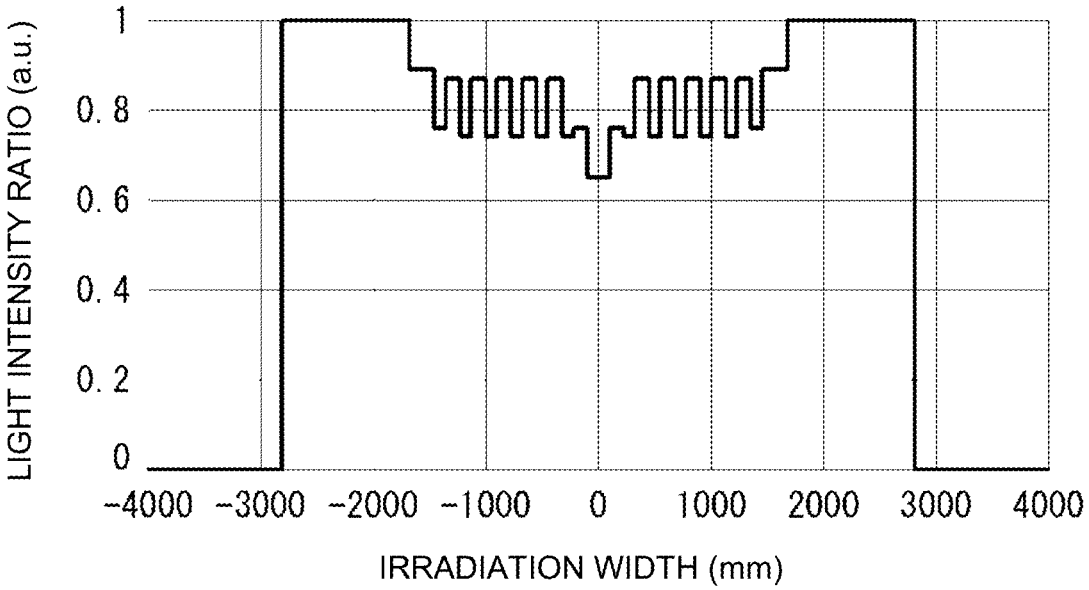
FIG. 17 is a drawing showing the cross section intensity of irradiation on a virtual third target surface when light is irradiated on the first target surface from the lighting device of the second embodiment.

Drawings are used to explain the lighting device of a second embodiment. FIG. 13 is a schematic view showing the state of light irradiated on the first target surface from the lighting device of the second embodiment. FIG. 14 is a partial enlarged view of FIG. 13 showing the state of light in the emission vicinity when light is irradiated on the first target surface from the lighting device of the second embodiment. FIG. 15 is a drawing showing the cross section intensity of irradiation on the first target surface when light is irradiated on the first target surface from the lighting device of the second embodiment. FIG. 16 is a drawing showing the cross section intensity of irradiation on a virtual second target surface when light is irradiated on the first target surface from the lighting device of the second embodiment. FIG. 17 is a drawing showing the cross section intensity of irradiation on the virtual third target surface when light is irradiated on the first target surface from the lighting device of the second embodiment. However, the cross section intensities in FIG. 15 to FIG. 17 are the results of the simulation. In FIG. 15 to FIG. 17, the horizontal axis shows the irradiation width (mm), and the vertical axis shows the light intensity ratio (a.u.).

With the first target surface as the reference, the lighting module is at a height of 4.5 m, the second target surface is at a height of 1.5 m, and the third target surface is at a height of 1 m.

The lighting device 100 of the second embodiment comprises: a plurality of lighting modules 50 for which a plurality of light emitting devices are aligned in an array form or a staggered form; and control devices with which, when light is irradiated on a first target surface R1 separated by a prescribed distance from the plurality of lighting modules, the light quantity of each of the plurality of light emitting devices is adjusted so that the sum of the light quantity per unit area of the part for which light overlaps in the first target surface R1 is within ±40% with respect to the light quantity per unit area of the part for which light does not overlap, preferably within ±30% and more preferably within ±20%. This makes it possible to provide a highly efficient lighting device that can reduce illuminance unevenness.

The lighting device 100 of the second embodiment is explained using three lighting modules 50 to simplify the explanation. In contrast to the lighting device of the first embodiment, the lighting device of the second embodiment has the illuminance set at a detailed level for a portion of the lighting module at both ends and the lighting module in the center in the part for which light overlaps. By doing a detailed setting of the illuminance of the plurality of light emitting devices, it is possible to further reduce illuminance unevenness even in part B in which light overlaps. For example, when the light quantity from the lighting modules at both ends in the part for which light does not overlap is set to 100%, the light quantity near the center in the center lighting module is 65%, and the light quantity decreases as it faces the outer circumference from 63% to 50%, 37%, 24%, and 11%. Also, it increases as it faces from the outer circumference toward the center in the part for which light overlaps in the lighting modules at both ends, from 11% to 24%, 37%, 50%, 63%, 76%, 89%, and 100%. However, the sum of the light quantity per unit area of the part for which light overlaps in the first target surface R1 separated by a prescribed distance from the three lighting modules is approximately the same as the light quantity per unit area of the part for which light does not overlap. In other words, in the first target surface R1, when the light quantity from the center lighting module is 65%, the light quantity from the right side lighting module is 11%, and the light quantity from the left side lighting module is 24%, the total is 100%. Similarly, when the light quantity from the center lighting module is 63%, and the light quantity from the right side lighting module is 37%, the total is 100%. When the light quantity from the center lighting module is 37%, and the light quantity from the right side lighting module is 63%, the total is 100%. Furthermore, when the light quantity from the center lighting module is 24%, and the light quantity from the right side lighting module is 76%, the total is 100%. Thus, in the first target surface R1, illuminance unevenness does not occur easily.

When assuming a second target surface R2 between the lighting modules 50 and the first target surface R1, the sum of the light quantity per unit area of the part for which light overlaps in the second target surface R2 is within ±50% with respect to the light quantity per unit area of the part for which light does not overlap, and is preferably within 40%. This makes it possible to reduce illuminance unevenness in the second target surface R2 as well.

When assuming a third target surface R3 between the first target surface R1 and the second target surface R2, the sum of the light quantity per unit area of the part for which light overlaps in the third target surface R3 is preferably within ±50% with respect to the light quantity per unit area of the part for which light does not overlap, and more preferably within 40%. This makes it possible to reduce illuminance unevenness in the third target surface R3 as well. By doing detailed setting of the light quantity of the light emitting device in this way, it is possible to reduce illuminance unevenness not only in the first target surface R1 but also in the second target surface R2 and the third target surface R3, making it possible to perform uniform irradiation. In other words, because the difference in light quantity between brightness and darkness is kept to within 40%, it is possible to eliminate extremely dark parts. Also, it is possible to reduce illuminance unevenness as the first target surface R1 is approached from the second target surface R2.

In the lighting device, the uniformity represented by Formula (1) in the first target surface R1 is preferably 80% or greater.

$$\text{Uniformity (\%)}=((\text{Minimum illuminance}/\text{Maximum illuminance})\times 100) \quad \text{(Formula 1)}$$

Here, "uniformity" is an index of the evenness of illuminance distribution. The greater the uniformity, the more even the brightness.

Here, the uniformity in the first target surface R1 is 100%. However, because this is a result of simulation, the actual uniformity is thought to be at least 90% or greater, preferably 95% or greater.

In the lighting device, the uniformity represented by Formula (1) in both the second target surface R2 and the third target surface R3 is a value higher than 60%.

Also, by the difference in brightness and darkness of adjacent irradiation regions in the second target surface R2 and the third target surface R3 being small, it is possible to reduce illuminance unevenness. In other words, with the second target surface R2, if the irradiation width is within ±1200 mm, the difference in the light quantity between brightness and darkness is within 20%. Also, with the third target surface R3, except for being within ±300 mm near the center, if the irradiation width is ±300 mm or more and ±1500 mm or less, the difference in light quantity between brightness and darkness is within 20%.

Thus, by adjusting the irradiation width from the lighting module and the light overlapping condition considering the height of the irradiation object, it is possible to reduce the illuminance unevenness in the irradiation object.

Third Embodiment

Figure 18:
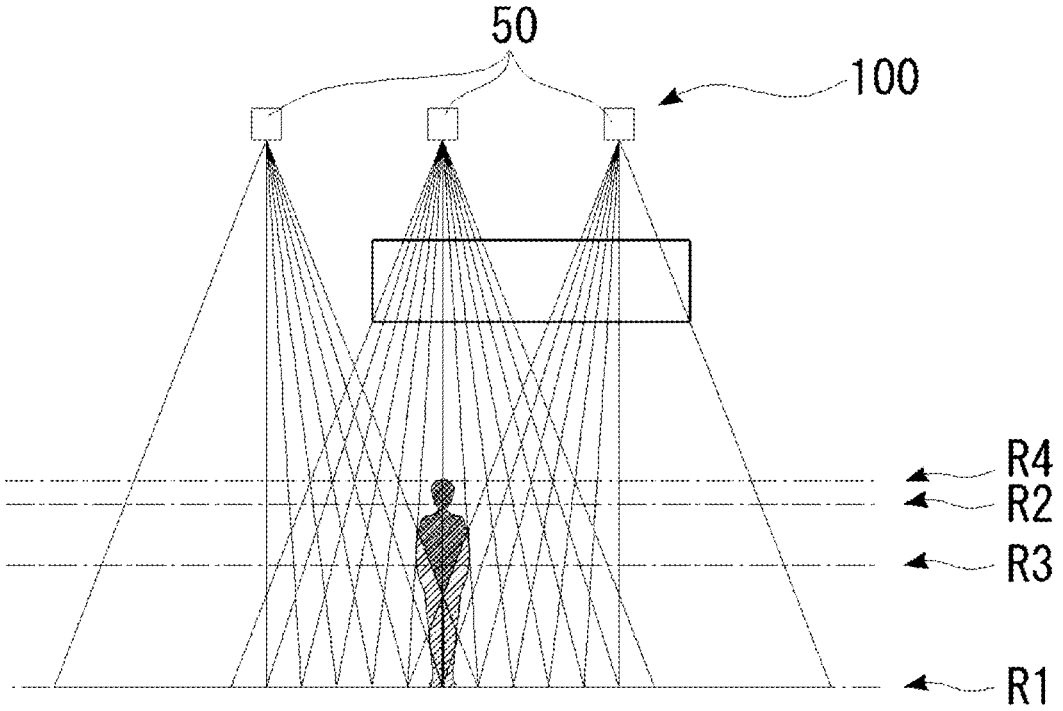
FIG. 18 is a schematic view showing the state of light irradiated on the first target surface from the lighting device of a third embodiment.
Figure 19:
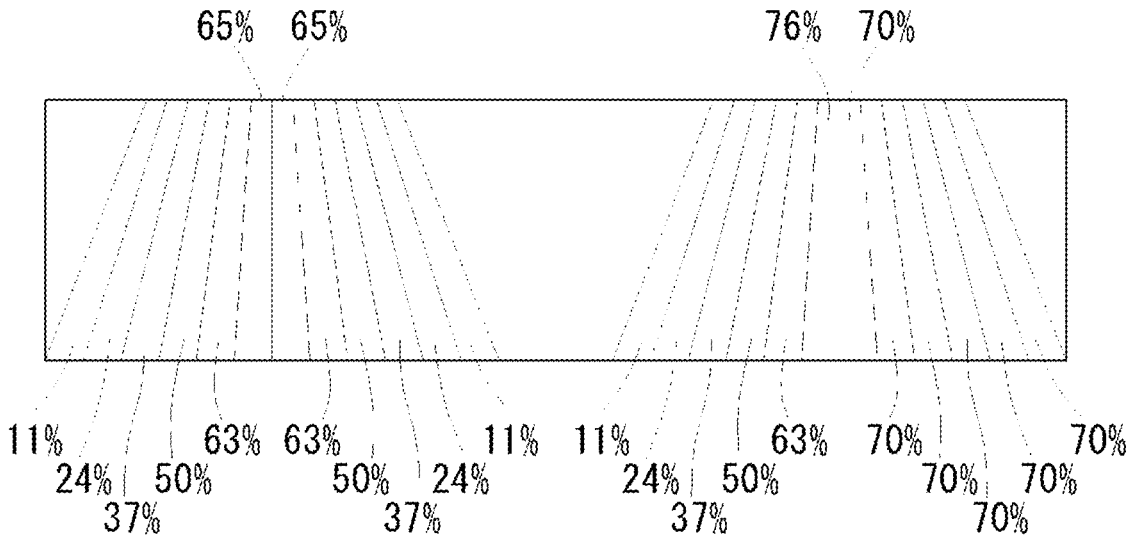
FIG. 19 is an enlarged partial view of FIG. 18 showing the state of light in the emission vicinity when light is irradiated on the first target surface from the lighting device of the third embodiment.
Figure 20:
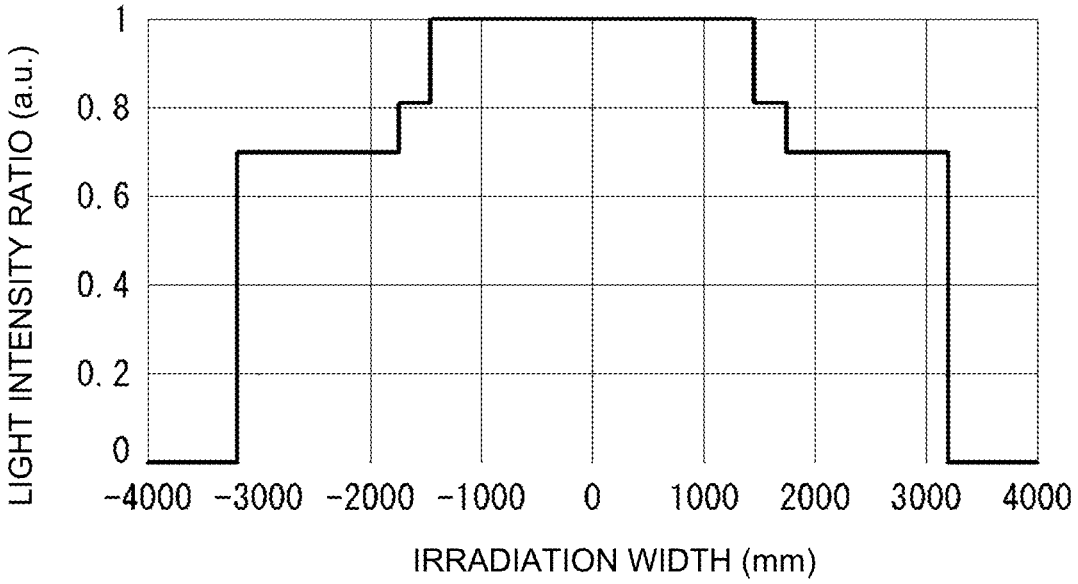
FIG. 20 is a drawing showing the cross section intensity of irradiation on the first target surface when light is irradiated on the first target surface from the lighting device of the third embodiment.
Figure 21:
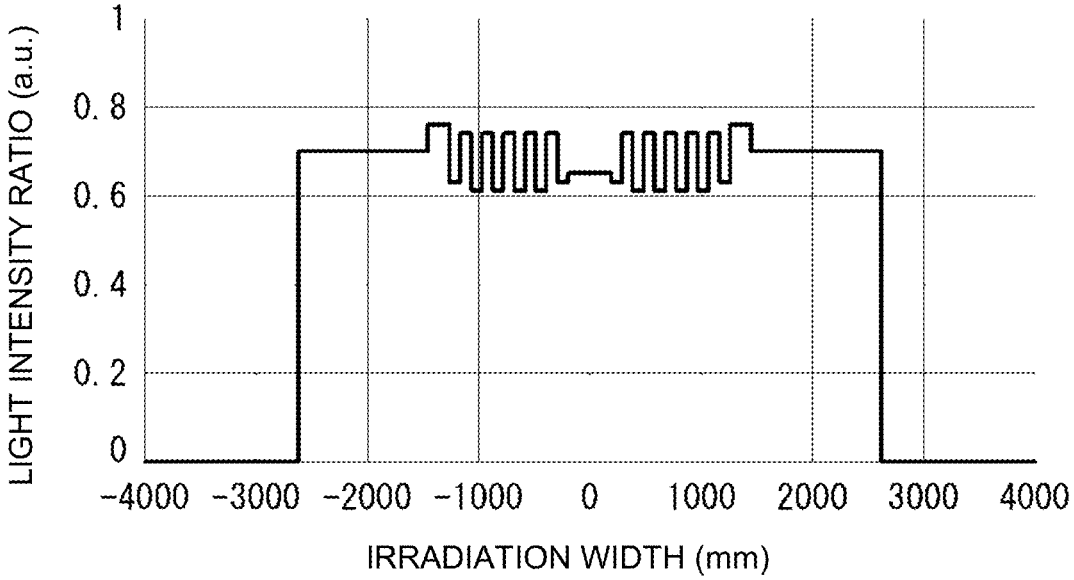
FIG. 21 is a drawing showing the cross section intensity of irradiation on a virtual second target surface when light is irradiated on the first target surface from the lighting device of the third embodiment.
Figure 22:
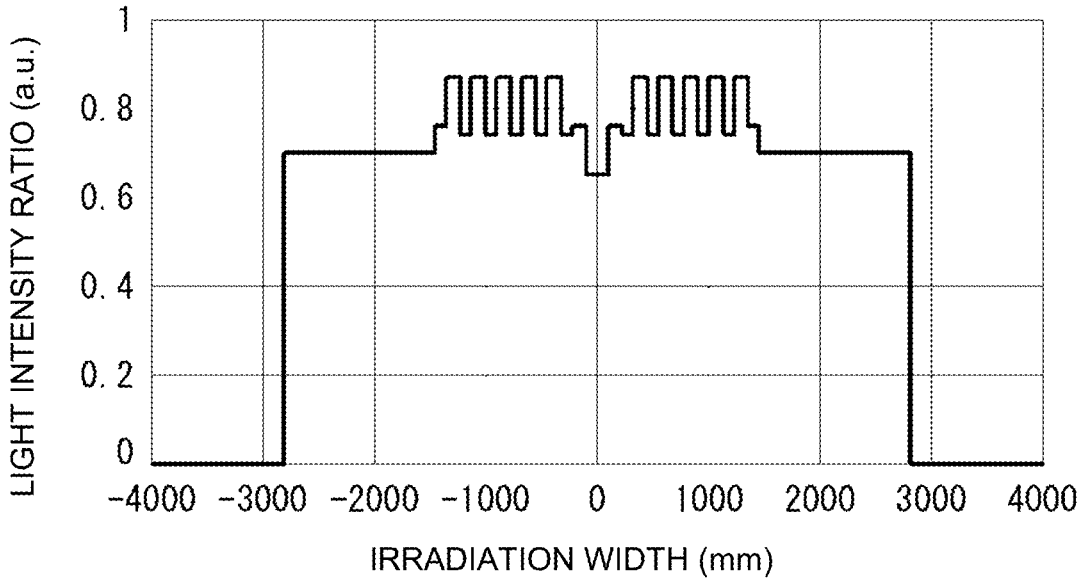
FIG. 22 is a drawing showing the cross section intensity of irradiation on a virtual third target surface when light is irradiated on the first target surface from the lighting device of the third embodiment.

Drawings are used to explain the lighting device of a third embodiment. FIG. 18 is a schematic view showing the state of light irradiated on the first target surface from the lighting device of the third embodiment. FIG. 19 is a partial enlarged view of FIG. 18, showing the state of light in the emission vicinity when light is irradiated on the first target surface from the lighting device of the third embodiment. FIG. 20 is a drawing showing the cross section intensity of irradiation in the first target surface when light is irradiated on the first target surface from the lighting device of the third embodiment. FIG. 21 is a drawing showing the cross section intensity of irradiation on the virtual second target surface when light is irradiated on the first target surface from the lighting device of the third embodiment. FIG. 22 is a drawing showing the cross section intensity of irradiation on the virtual third target surface when light is irradiated on the first target surface from the lighting device of the third embodiment. However, the cross section intensities in FIG. 20 to FIG. 22 are the results of simulation. In FIG. 20 to FIG. 22, the horizontal axis shows the irradiation width (mm), and the vertical axis shows the light intensity ratio (a.u.). For comparison of FIG. 16 and FIG. 17, the light intensity ratio of FIG. 21 and FIG. 22 are values with respect to the light intensity ratio of FIG. 16 and FIG. 17.

Using the first target surface as the reference, the lighting module is at height 4.5 m, the second target surface is at height 1.5 m, and the third target surface is at height 1 m.

The lighting device 100 of the third embodiment comprises: a plurality of lighting modules 50 for which a plurality of light emitting devices are aligned in an array form or a staggered form; and control devices with which, when light is irradiated on a first target surface R1 separated by a prescribed distance from the plurality of lighting modules, the light quantity of each of the plurality of light emitting devices is adjusted so that the sum of the light quantity per unit area of the part for which light overlaps in the first target surface R1 is within ±40% with respect to the light quantity per unit area of the part for which light does not overlap, preferably within ±30%. When assuming the second target surface R2 between the lighting modules 50 and the first target surface R1, the sum of the light quantity per unit area of the part for which light overlaps in the second target surface R2 is within ±30% with respect to the light quantity per unit area of the part for which light does not overlap. This makes it possible to provide a highly efficient lighting device that can reduce illuminance unevenness.

The lighting device 100 of the third embodiment is explained using three lighting modules 50 to simplify the explanation. Different from the lighting device of the second embodiment, the lighting device of the third embodiment lowers the light quantity of a portion of the lighting modules of both ends that irradiate on the part for which light does not overlap. In other words, while reducing the illuminance unevenness in the second target surface R2, it is possible to keep the illuminance unevenness in the first target surface R1 low as well. For example, when the light quantity from the center lighting module in the part for which light overlaps in the first target surface R1 is 100%, the light quantity of the part for which light does not overlap in the lighting modules of both ends is approximately 70%. The light quantity near the center in the center lighting module is 65%, and the light quantity facing the outer circumference decreases from 63% to 50%, 37%, 24%, and 11%. Also, in the lighting modules of both ends, the light quantity increases facing the center from the outer circumference in the part for which light overlaps from 11% to 24%, 37%, 50%, 63%, and 76%, and the light quantity in the part for which light does not overlap is 70%. However, the sum of the light quantity per unit area of the part for which light overlaps in the first target surface R1 separated by a prescribed distance from the three lighting modules is within ±40% with respect to the light quantity per unit area of the part for which light does not overlap, preferably approximately ±30%. In other words, in the first target surface R1, when the light quantity from the center lighting module is 65%, the light quantity from the right side lighting module is 11%, and the light quantity from the left side lighting module is 24%, the total is 100%. Similarly, when the light quantity from the center lighting module is 63%, and the light quantity from the right side lighting module is 37%, the total is 100%. When the light quantity from the center lighting module is 37%, and the light quantity from the right side lighting module is 63%, the total is 100%. Furthermore, when the light quantity from the center lighting module is 24%, and the light quantity from the right side lighting module is 76%, the total is 100%. On the other hand, the light quantity from the right side lighting module in the part for which light does not overlap is 70%. Thus, in the first target surface R1, the difference in the light quantity is within ±30%, so illuminance unevenness does not occur easily.

When assuming the second target surface R2 between the lighting modules 50 and the first target surface R1, it is preferable that the sum of the light quantity per unit area of the part for which light overlaps be within ±30% with respect to the light quantity per unit area of the part for which light does not overlap, more preferably within 20%. This makes it possible to reduce illuminance unevenness in the second target surface R2 as well.

When assuming the third target surface R3 between the first target surface R1 and the second target surface R2, it is preferable that the sum of the light quantity per unit area of the part for which light overlaps in the third target surface R3 be within ±30% with respect to the light quantity per unit area of the part for which light does not overlap, more preferably within 25%. This makes it possible to reduce illuminance unevenness in the third target surface R3 as well. By doing detailed setting of the light quantity of the light emitting device in this way, it is possible to reduce illuminance unevenness not only in the first target surface R1, but also in the second target surface R2 and the third target surface R3, and possible to perform uniform irradiation. In other words, by reducing the illuminance unevenness in the second target surface R2, it is possible to also reduce illuminance unevenness in the third target surface R3. Also, since the difference in light quantity between brightness and darkness in the third target surface R3 is suppressed to within 30%, it is possible to eliminate extremely dark parts. Also, it is possible to reduce illuminance unevenness as the second target surface R2 is approached from the third target surface R3.

In the lighting device 100 of the third embodiment, it is preferable that the uniformity represented by the abovementioned Formula (1) in the first target surface be 60% or greater, and the uniformity represented by the abovementioned Formula (1) in the second target surface be 80% or greater.

Here, the uniformity in the first target surface R1 is approximately 70%. The uniformity in the second target surface R2 is approximately 80%. However, since these are results of simulation, it is thought that there is slight variation in the actual uniformity.

When assuming the third target surface R3 between the first target surface R1 and the second target surface R2, it is preferable that the uniformity represented by the abovementioned Formula (1) in the third target surface R3 be 70% or greater. This makes it possible to reduce illuminance unevenness in the third target surface R3 as well.

When assuming a fourth target surface R4 between the lighting modules 50 and the second target surface R2, it is preferable that the uniformity represented by the abovementioned Formula (1) in the fourth target surface R4 be 80% or greater. This allows a reduction in illuminance unevenness in the fourth target surface R4 as well.

In the lighting device, the uniformity represented by the Formula (1) in the second target surface R2 and the third target surface R3 as well as in the fourth target surface R4 is a value higher than 60%.

Also, by the difference between light and dark in adjacent irradiation regions being smaller in the second target surface R2, the third target surface R3, and the fourth target surface R4, it is possible to reduce illuminance unevenness. In other words, if the irradiation width with the second target surface R2 is within ±2500 mm, the difference in light quantity of brightness and darkness is within 20%. Also, if the irradiation width with the third target surface R3 is also within ±2500 mm, the difference in the light quantity of brightness and darkness is within 25%.

Thus, by adjusting the irradiation width from the lighting module and the light overlapping condition considering the height of the irradiation object, it is possible to reduce illuminance unevenness in the irradiation object.

Figure 23:
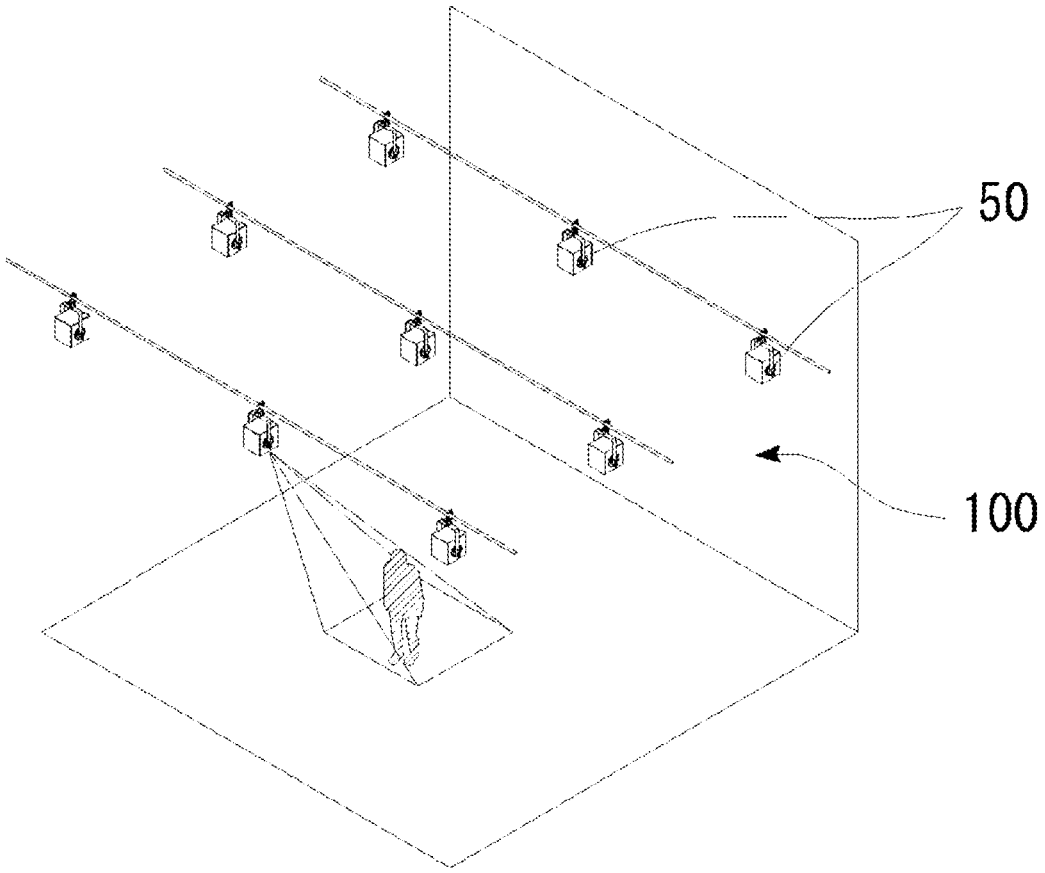
FIG. 23 is a schematic view of the lighting device for which the lighting modules are placed in matrix form.

It is preferable that the lighting modules 50 in the lighting device in the first to third embodiments be arranged in an array form or a staggered form. FIG. 23 is a schematic view of the lighting device with the lighting modules placed in a matrix form. For the convenience of explanation, the light overlapping condition was explained with a flat surface in a perpendicular direction to the floor which is the first target surface, but the same kind of light overlap occurs in a flat surface that is in the parallel direction to the floor as well. For the lighting device, the irradiation location can be freely selected simply by turning the control device on and off, and it is possible to irradiate the first target surface without illuminance unevenness.

It is preferable that the irradiation angle of one lighting module be 30 degrees or more to 60 degrees or less. This is because it is possible to narrow the orientation.

Following, each component is described in detail.

Lighting Module

For example, the lighting module has a plurality of light emitting devices placed in an array form or a staggered form on the substrate. There is a plurality of lighting modules, and it is preferable to have two, three, or four, etc., as one aggregate, and to prepare a plurality of the one aggregate. As an example, it is possible to obtain high luminous flux by increasing the overall light quantity by irradiating the same region using a plurality of lighting modules as one aggregate. When there is insufficient brightness with one lighting module, it is possible to increase the brightness to another level by using an aggregate using a plurality of the lighting modules. As another example, it is possible to irradiate a 3 m×3 m region using one lighting module, and to irradiate 6 m×6 m using an aggregate of four lighting modules. It is possible to set the irradiation conditions in detail by narrowing the irradiation range of one lighting module. On the other hand, it is possible to produce a lighting module that is inexpensive by reducing the number of parts such as the number of light emitting devices by broadening the irradiation range of one lighting module.

Light Emitting Device

The light emitting device may be only a light emitting element, but it is preferable to have a combination of a semiconductor light emitting element and a wavelength conversion member. With the combination of the light emitting element and the wavelength conversion member, it is possible to output various light emission colors such as white, light bulb color, multicolor, etc. The light emitting device is sufficient provided it is configured so that the light from the light emitting element directly or indirectly enters the wavelength conversion member, and the light emitting element and the wavelength conversion member may be directly joined, may be joined with an adhesive agent interposed, or may be placed apart. For example, it is also possible to use the light emitting device for which the light emitting element is placed inside a recess of a package having a lead, and the wavelength conversion member is placed inside the recess to cover the light emitting element. It is also possible to use the light emitting device for which one or two or more light emitting elements are placed on one or two or more substrates, for which one or two or more plate shaped wavelength conversion members are joined on the light emitting element using an adhesive agent, and for which around the light emitting element and/or the wavelength conversion member is covered with a reflective member. It is also possible to use the light emitting device for which the light emitting element is placed on the substrate, for which a plate shaped translucent member such as glass or ceramic with the wavelength conversion member applied is joined on that light emitting element using an adhesive agent, and for which around the light emitting element and the wavelength conversion member is covered with the reflective member. It is also possible to have these light emitting devices placed in an array form or a staggered form, and to have the rod lens placed so that light from those light emitting devices is emitted in a desired direction. It is preferable to provide one rod lens in one light emitting device, but it is also possible to provide a plurality of rod lenses in one light emitting device, or to provide one rod lens in a plurality of light emitting devices.

Package

The package can comprise the light emitting element, a first covering member, a first translucent member, and a second translucent member. The light emitting element comprises a pair of electrodes on a first surface. Because the first covering member covers the side surface of the light emitting element, it should be insulating. It is preferable that the first covering member be reflective, but it may also be translucent. For the reflective first covering member, for example, it is possible to use a member containing approximately 60 wt % of silica and white titanium oxide in a silicone resin, and this can be formed using compression molding, transfer molding, injection molding, printing, spraying, etc. It is also possible to mold the first covering member into a plate shape, and to cut it into a prescribed size to make a cuboid.

On the first translucent member of the plate shaped member, the second translucent member in liquid form is applied, and a plurality of light emitting elements are adhered. The second translucent members in liquid form are formed to be separate from each other. Each second translucent member can be any shape in the plan view corresponding to the shape of the light emitting element, examples including a square, rectangle, circle, or oval. The gap between adjacent second translucent members can be set as appropriate according to the shape of the package and the number of packages used. Also, the second translucent member is preferably formed to cover 70% or more of the area of the first translucent member of the plate shaped member. The first translucent member itself can be the wavelength conversion member, can contain the wavelength conversion member in resin or ceramic, or can contain the wavelength conversion member in the second translucent member.

With the description above, the light emitting element and the first translucent member were joined with the second translucent member existing therebetween, but it is also possible to join them directly without using the second translucent member. In other words, after mounting the light emitting element on the first translucent member, it is also possible to input the liquid form first translucent member in the periphery of this light emitting element.

Here, "plate shaped" indicates a member comprising a large surface area on which it is possible to mount one or two or more light emitting elements, and this can also be said another way using terminology such as sheet form, film form, or layer form, for example.

Light Emitting Element

As the light emitting element, it is possible to use a semiconductor light emitting element such as a light emitting diode, etc., for example, and possible to use a light emitting element capable of emitting visible light such as blue, green, red, etc. The semiconductor light emitting element comprises a laminated structure that includes light emitting layers, and electrodes. The laminated structure comprises a first surface of the side on which the electrodes are formed, and a second surface on the side opposite to that, that is the surface at which light is extracted.

The laminated structure includes a semiconductor layer that includes a light emitting layer. Furthermore, it is also possible to comprises a translucent substrate such as sapphire, etc. As an example of the semiconductor laminate, it is possible to include three semiconductor layers, a first electrically conductive semiconductor layer (e.g. an n type semiconductor layer), a light emitting layer (active layer), and a second electrically conductive layer (e.g. a p type semiconductor layer). As the semiconductor layer capable of emitting light of ultraviolet light, or visible light of from blue light to green light, for example, it is possible to form this from a semiconductor material of a group III-V compound semiconductor, etc.

More specifically, it is possible to use a nitride type semiconductor material such as $In_XAl_YGa_{1-X-Y}N$ ($0 \leq X$, $0 \leq Y$, $X+Y \leq 1$), etc. As the semiconductor laminate capable of emitting red light, it is possible to use GaAs, GaAlAs, GaP, InGaAs, InGaAsP, etc. For the electrode, copper is preferable.

First Covering Member

The first covering member is preferably a resin member having as a main component, for example, a thermosetting resin such as silicone resin, silicone modified resin, epoxy resin, phenol resin, etc.

The first covering member is preferably a light reflective resin member. The light reflective resin means a resin material for which the reflection rate with respect to light from the light emitting element is 70% or greater. For example, white resin, etc., is preferable. By light that reached the first covering member being reflected and facing the light emitting surface of the light emitting device, it is possible to increase the light extraction efficiency of the light emitting device. Also, as the first covering member, a translucent resin member may also be used. For the first covering member in this case, it is possible to use the same material as the first translucent member described later.

As the light reflective resin, for example, it is possible to use an item for which a light reflective substance is dispersed in a translucent resin. As the light reflective substance, suitable examples include titanium oxide, silicon oxide, zirconium oxide, potassium titanate, aluminum oxide, aluminum nitride, boron nitride, mullite, etc. For the light reflective substance, it is possible to use a particle form, fiber form, thin sheet form, etc., but fiber form articles are particularly preferable because they are expected to have the effect of reducing the thermal coefficient of the first covering member as well.

First Translucent Member

The first translucent member is placed on the second surface of the light emitting element. For the material of the first translucent member, it is possible to use resin, glass, etc. As the resin, it is possible to use a thermosetting resin such as silicone resin, silicone modified resin, epoxy resin, phenol resin, etc., or a thermoplastic resin such as polycarbonate resin, acrylic resin, methylpentene resin, polynorbornene resin, etc. Silicone resin which has excellent light resistance and heat resistance is particularly suitable.

In addition to the abovementioned translucent material, the first translucent member may also contain a phosphor as the wavelength conversion member. For the phosphor, an item that can be excited by the light emitted from the light emitting element is used. For example, as the phosphor that can be excited by a blue light emitting element or an ultraviolet light emitting element, examples include cerium activated yttrium aluminum garnet type phosphor (YAG: Ce); cerium activated lutetium aluminum garnet type phosphor (LAG: Ce); nitrogen-containing calcium aluminosilicate activated by europium and/or chromium ($CaO—Al_2O_3—SiO_2$: Eu, Cr); europium activated silicate type phosphor ($(Sr, Ba)_2SiO_4$: Eu); β sialon phosphor, nitride type phosphors such as CASN type phosphor, SCASN type phosphor, etc.; KSF type phosphor ($K_2SiF_6$: Mn); sulfide type phosphor, quantum dot type phosphor, etc. By combining these phosphors with blue light emitting elements or ultraviolet light emitting elements, it is possible to manufacture light emitting devices of various colors (e.g. a white light emitting device).

Also, for the first translucent member, for the purpose of adjusting viscosity, etc., various types of filler, etc., may also be contained.

Substrate

The substrate has wiring. For a support member of the substrate, it is preferable that an insulating material be used, and preferable that a material through which light emitted from the light emitting element or outside light, etc., do not transmit easily be used. The substrate may be a material that has a certain degree of strength, or a material used as a sheet or flexible substrate. Specific examples include a ceramic such as alumina, aluminum nitride, mullite, etc., a resin such as phenol resin, epoxy resin, polyimide resin, bismaleimide triazine resin, or polyphthalamide resin.

Control Device

As the control device, a micro control unit (hereafter also referred to as MCU) is incorporated. The MCU is a microprocessor to be incorporated, in which a computer system is integrated in one integrated circuit. For the control device, the MCU can be placed on the substrate on which the light emitting device is placed, but it is preferable that the MCU be placed separately from the lighting module. By dimming a plurality of light emitting devices from on to off according to the movement or standing position of a performer or the position of an irradiation object on the stage, it is possible to realize the lighting device with little illuminance unevenness like that described above.

Rod Lens

The rod lens has a role of discharging the light from the light emitting device to outside. It is possible to narrow the orientation of the rod lens, and to make the light within the emitting surface even.

The rod lens emits from an emission end surface a uniform light beam for which illuminance unevenness or color unevenness is reduced for light beams made incident from the incident end surface. The rod lens is formed in a columnar shape such as a polygonal column shape such as a square column or hexagonal column, or an elliptical column or round column, etc., and the refractive index is uniform in the interior. Also, the incident end surface and the emitting end surface are formed in a polygonal shape such as a square, hexagon, etc., an elliptical shape, a circular shape, etc., these are formed with the same surface areas, or the emitting surface is formed to be a broader surface area than the incident surface, and these are formed in parallel. As the forming material for the rod lens, examples include glass, transparent resin, etc. It is also possible to use a hollow item for the rod lens.

The rod lens has light beams emitted from the light emitting device made incident from the incident end surface, and by the light beams that are made incident on the emitting end surface fully reflected by the inside surface of the rod lens, and the light beams that are made incident from the incident end surface without being fully reflected on the emitting end surface being overlapped on the emitting end surface, the illuminance unevenness and color unevenness of the light is made uniform at the emitting end surface.

Also, the rod lens is formed in a shape by which it makes the illuminance unevenness and the color unevenness for the light of the light beams emitted from the emitting end surface uniform, and irradiates to the lens without omission the light beams emitted from the emitting end surface of the rod lens, and is placed in a specified position.

Lens

One, or two or more lenses may be used. It is possible to control the irradiation range by combining a plurality of lenses. For the lens, lenses of shapes such as biconvex, flat convex, convex meniscus, concave meniscus, flat concave, biconcave, etc., can be combined as appropriate. For the lens, it is possible to use a transparent plastic type such as glass or organic glass.

Working Example

Figure 24:
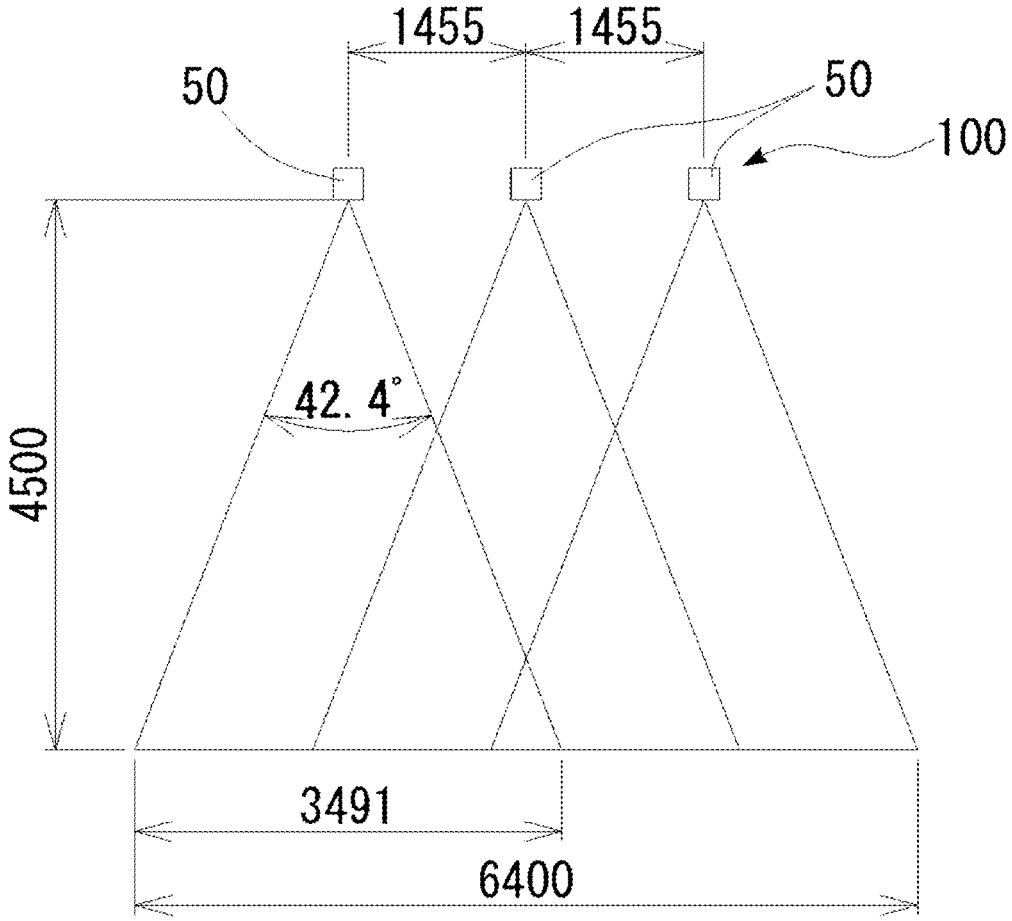
FIG. 24 is a schematic view showing the projection conditions of the lighting device of a working example and a comparison example.
Figure 25:
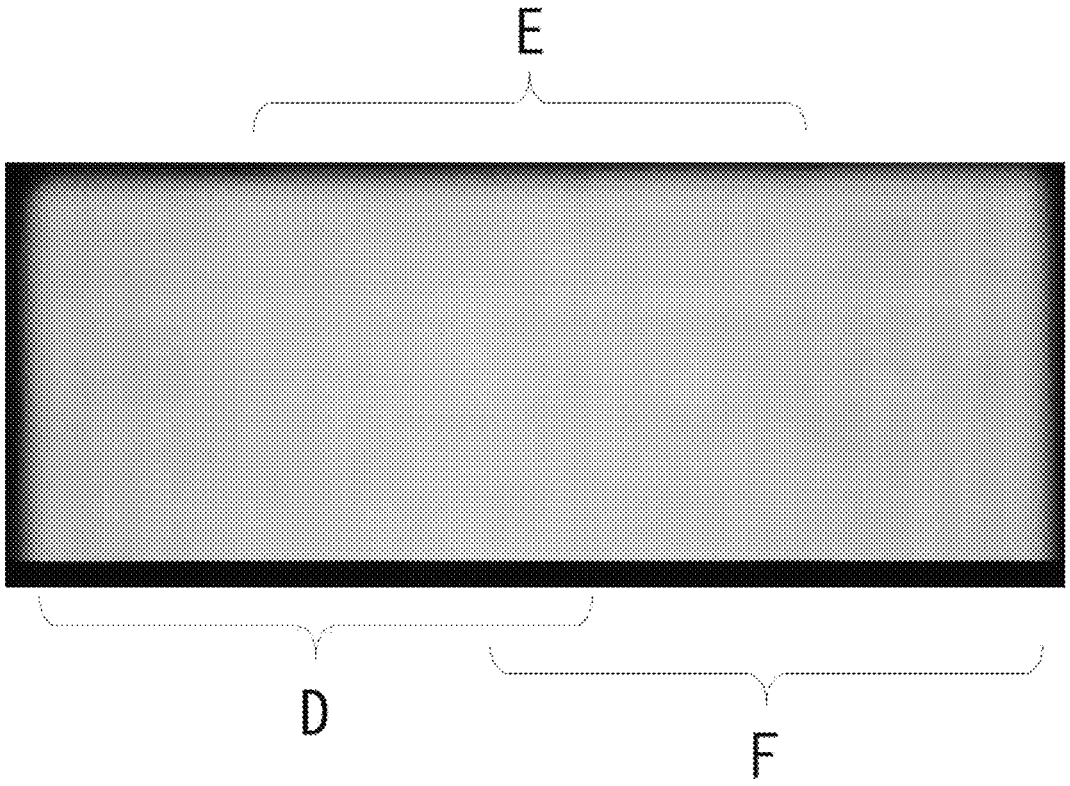
FIG. 25 is a photograph showing the irradiation state of working example 1.
Figure 26:
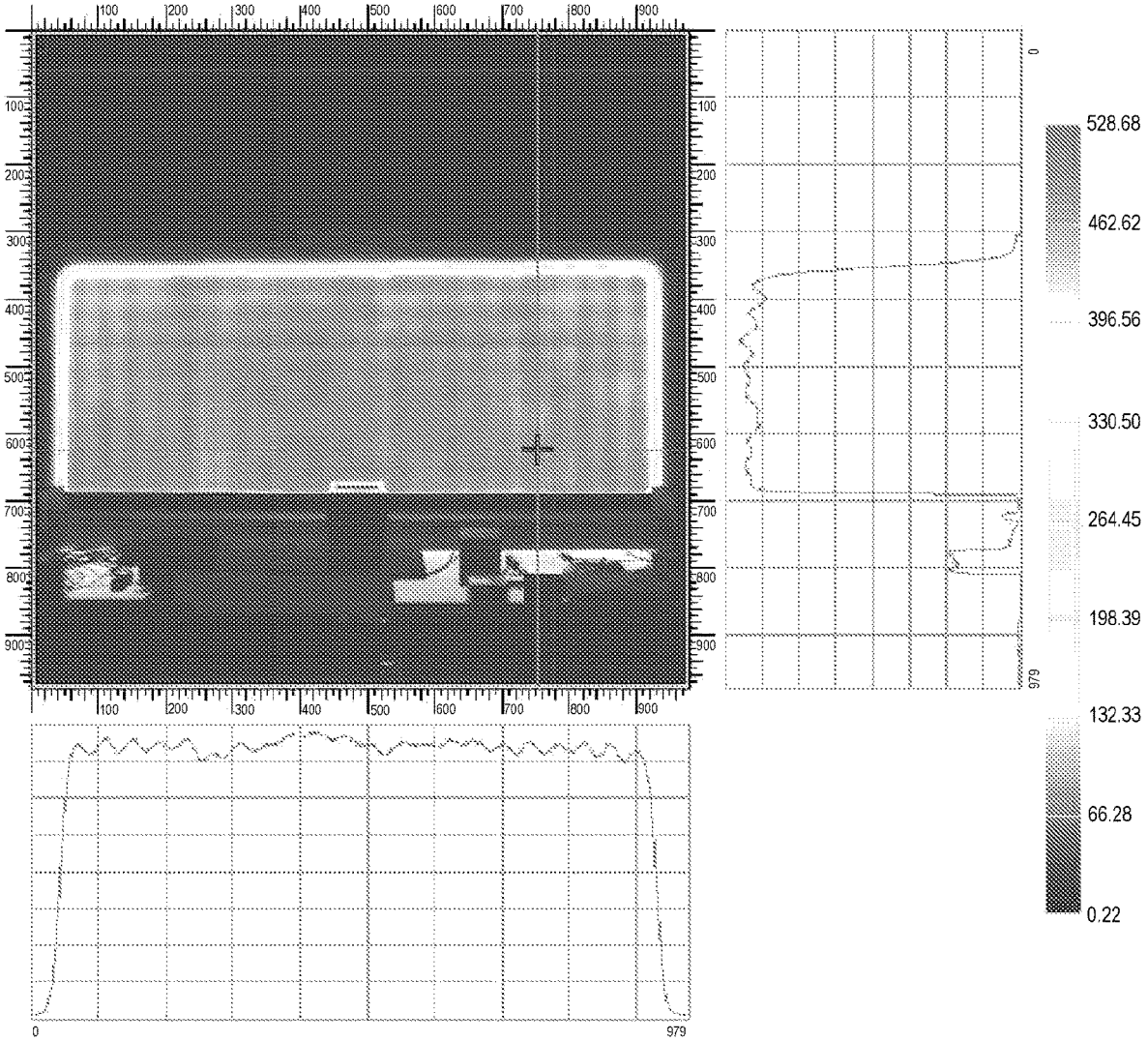
FIG. 26 is a drawing showing the cross section intensity of irradiation in working example 1.
Figure 27:
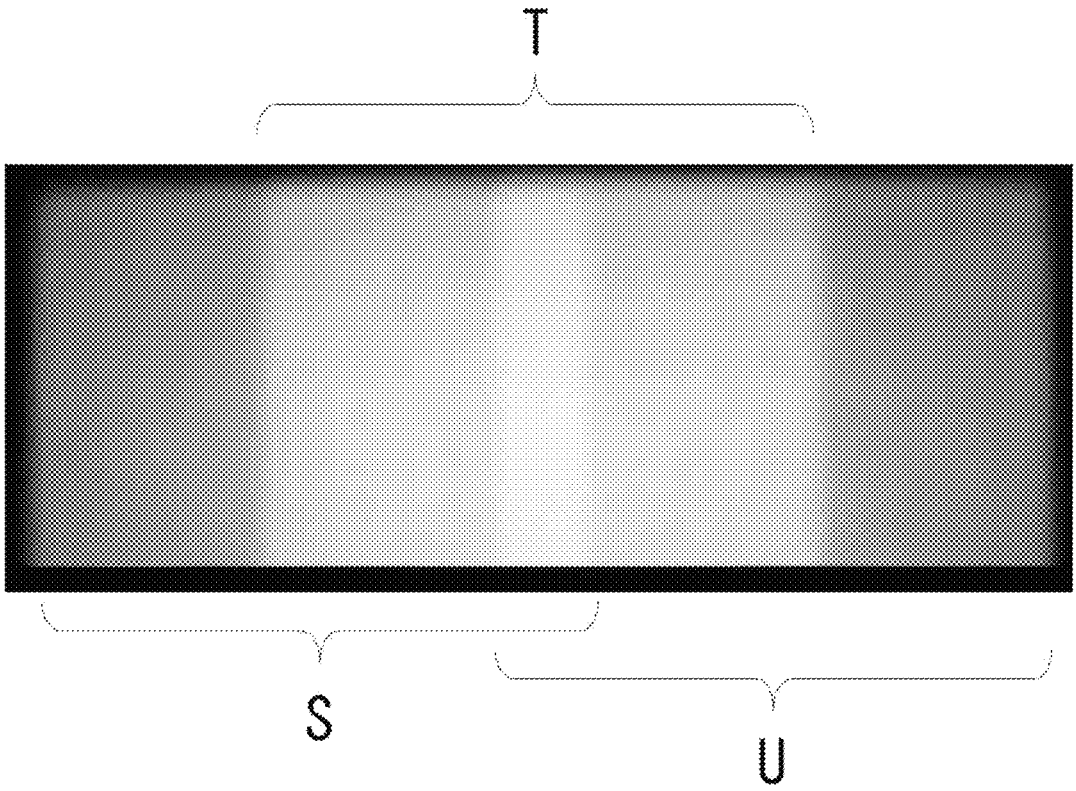
FIG. 27 is a photograph showing the irradiation state of comparison example 1.
Figure 28:
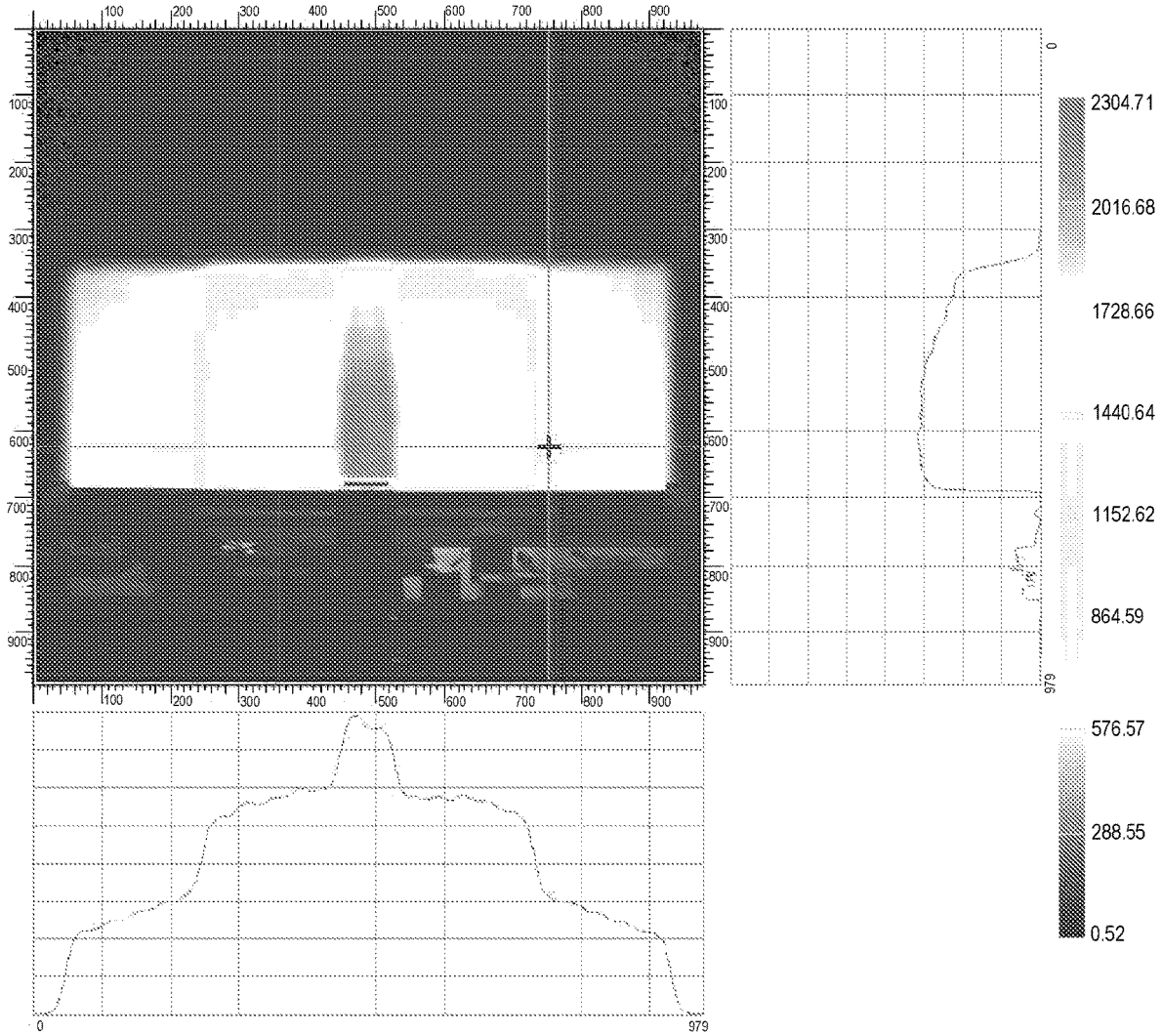
FIG. 28 is a drawing showing the cross section intensity of comparison example 1.

The lighting device using three lighting modules is used as an example to explain the lighting device of a working example. FIG. 24 is a schematic view showing the projection conditions of the lighting device of the working example and a comparison example. FIG. 25 is a photograph showing the irradiation state in working example 1. FIG. 26 is a drawing showing the cross section intensity of irradiation in working example 1. FIG. 27 is a photograph showing the irradiation state in comparison example 1. FIG. 28 is a drawing showing the cross section intensity of irradiation in comparison example 1.

The lighting device 100 of working example 1 uses three lighting module 50. The lighting device comprises: three lighting modules 50 for which the plurality of light emitting devices are aligned in an array form or a staggered form, and the control devices with which, when light is irradiated on the first target surface separated by a prescribed distance from the three lighting modules, the light quantity of each of the three light emitting devices is adjusted so that the sum of the light quantity per unit area of the part for which light overlaps in the first target surface is within ±20% with respect to the light quantity per unit area of the part for which light does not overlap.

The distance from the lighting modules 50 to the first target surface is approximately 4500 mm, and the gap between adjacent lighting modules 50 is approximately 1455 mm. This is a substantially square shape for which the length of one side of the first target surface irradiated from one lighting module 50 is approximately 3491 mm. The irradiation angle of one lighting module 50 is approximately 42.4°. This is a rectangle of approximately 6400 mm×3491 mm by irradiating the three lighting modules 50.

In the first target surface, the average value of the brightness is approximately 490 cd/m$^2$. The difference in the light quantity of the part for which light is irradiated on the first target surface is suppressed to within ±20%. Thus, even if the movement or standing position of the performer on the first target surface has shifted, it is possible to maintain the same brightness without switching the light quantity of the lighting modules.

In contrast, the lighting device of comparison example 1 is illuminated by the same light quantity for the entire irradiation surface of one lighting module. Therefore, when light from the three lighting modules is overlapped, the light quantity of the part for which light overlaps from the three lighting modules of the center part is the highest, the light quantity of the part for which light overlaps from the next two lighting modules is the next lower, and the light quantity of the part for which light does not overlap from one lighting module at the peripheral part is the lowest, so this has a substantially triangular cross section intensity with steps. In this case, it is brightest when the performer stands at the center part, but when shifted left or right a small amount even by 500 mm, it becomes darker by 20 to 30%, and if shifted left or right further by 2000 mm, it becomes darker by 50 to 70%. When it becomes darker or brighter simply by a small movement of the performer in this way, the audience will feel a strange sense from the lighting. Also, when the plurality of lighting modules are repeatedly turned on and off so as not to have it become darker or lighter simply by a small movement of the performer, the movement of the irradiation becomes faster, and the audience will feel a strange sense from the lighting.

The lighting device of the present embodiment can be used for a television studio or theater stage, particularly for a suspension light, etc.

What is claimed is:

1. A lighting device comprising:

a plurality of lighting modules each including a plurality of light emitting devices aligned in an array form or a staggered form; and a plurality of control devices configured to adjust light quantities of the light emitting devices of each of the lighting modules so that, when light is irradiated on a first target surface separated by a prescribed distance from the lighting modules, a sum of light quantities per unit area of a part for which light from the lighting modules overlaps in the first target surface is within ±20% with respect to a light quantity per unit area of a part for which light does not overlap in the first target surface.

2. The lighting device of claim 1, wherein the lighting modules include a first lighting module having at least a first light emitting device and a second lighting device, and in the part for which the light from the lighting modules overlaps in the first target surface, the control devices are configured to adjust a light quantity of the first light emitting device to be lower than a light quantity of the second light emitting device, when a first distance from the first light emitting device to the first target surface irradiated by the first light emitting device is longer than a second distance from the second light emitting device to the first target surface irradiated by the second light emitting device.

3. The lighting device according to claim 2, wherein the lighting modules include a second lighting module having at least a third light emitting device and a fourth light emitting device, with the second lighting module being adjacent to a first light emitting device side of the first lighting module, and in the part for which the light from the lighting modules overlaps in the first target surface, the control devices are configured to adjust a light quantity of the third light emitting device to be lower than a light quantity of the fourth light emitting device, when a third distance from the third light emitting device to the first target surface irradiated by the third light emitting device is longer than a fourth distance from the fourth light emitting device to the first target surface irradiated by the fourth light emitting device.

4. The lighting device according to claim 1, wherein the lighting modules include at least a third lighting module, a fourth lighting module, and a fifth lighting module, with the third lighting module and the fifth lighting module being placed with line symmetry with respect to the fourth lighting module, the control devices are configured to adjust light quantities of the third lighting module, the fourth lighting module and the fifth lighting module so that, in the first target surface, a sum of the light quantities per unit area of a part for which light from the third lighting module, the fourth lighting module, and the fifth lighting module overlaps, a sum of the light quantities per unit area of a part for which light from the third lighting module and the fourth lighting module overlaps, and a sum of the light quantities per unit area of a part for which light from the fifth lighting module and the fourth lighting module overlaps are within ±20%.

5. The lighting device according to claim 4, wherein the control devices are configured to adjust light quantities of the third lighting module, the fourth lighting module and the fifth lighting module so that, in the first target surface, the light quantity from the fourth lighting module in the part for which light from the third lighting module, the fourth lighting module, and the fifth lighting module overlaps is lower than the light quantity from the fourth lighting module in the part for which light from the third lighting module and the fourth lighting module overlaps.

6. The lighting device according to claim 1, wherein the control devices are configured to adjust the light quantities of the lighting modules so that a sum of light quantities per unit area of a part for which light from the lighting modules overlaps in a virtual second target surface between the lighting modules and the first target surface is within ±50% with respect to a light quantity per unit area of a part for which light does not overlap in the virtual second target surface.

7. The lighting device according to claim 1, wherein the control devices are configured to adjust the light quantities of the lighting modules so that a uniformity represented by Formula (1) in the first target surface is 80% or greater $$\text{Uniformity (\%)}=((\text{Minimum illuminance}/\text{Maximum illuminance})\times 100) \quad \text{(Formula 1).}$$

8. The lighting device according to claim 1, wherein each of the lighting modules is arranged so that an irradiation angle is 30 degrees or more and 60 degrees or less.

9. The lighting device of claim 1, wherein each of the light emitting devices has a semiconductor light emitting element and a wavelength conversion member.

10. The lighting device according to claim 1, wherein the light emitting devices include light emitting devices of two or more different types of color temperature.

11. The lighting device according to claim 1, wherein each of the lighting modules includes a rod lens that narrows an orientation from a corresponding one of the light emitting devices.

12. The lighting device of claim 6, wherein the virtual second target surface is arranged at a height of 1.5 m from the first target surface.

13. The lighting device according to claim 1, wherein the lighting modules are placed in an array form or a staggered form.

14. A lighting device comprising:

a plurality of lighting modules each including a plurality of light emitting devices aligned in an array form or a staggered form; and a plurality of control devices configured to adjust light quantities of the light emitting devices of each of the lighting modules so that, when light is irradiated on a first target surface separated by a prescribed distance from the lighting modules, a sum of light quantities per unit area of a part for which light from the lighting modules overlaps in the first target surface is within ±40% with respect to a light quantity per unit area of a part for which light does not overlap, and a sum of the light quantities per unit area of a part for which light from the lighting modules overlaps in a virtual second target surface between the lighting modules and the first target surface is within ±30% with respect to a light quantity per unit area of a part for which light does not overlap in the virtual second target surface.

15. The lighting device according to claim 14, wherein the control devices are configured to adjust the light quantities of the lighting modules so that a uniformity represented by Formula (1) in the first target surface is 60% or greater, and a uniformity represented by Formula (1) in the virtual second target surface is 80% or greater Uniformity (%)=((Minimum illuminance/Maximum illuminance)×100)(Formula 1).

16. The lighting device according to claim 15, wherein the control devices are configured to adjust the light quantities of the lighting modules so that a uniformity represented by Formula (1) in a virtual third target surface between the first target surface and the second target surface is 70% or greater.

17. The lighting device of claim 16, wherein the virtual third target surface is arranged at a height of 1 m from the first target surface.

18. The lighting device according to claim 15, wherein the control devices are configured to adjust the light quantities of the lighting modules so that a uniformity represented by Formula (1) in a virtual fourth target surface between the lighting modules and the second target surface is 80% or greater.

19. The lighting device according to claim 18, wherein the virtual fourth target surface is arranged at a height of 1.69 m from the first target surface.

* * * * *